US005451709A

United States Patent [19]

Minamitaka

[11] Patent Number: 5,451,709

[45] Date of Patent: Sep. 19, 1995

[54] AUTOMATIC COMPOSER FOR COMPOSING A MELODY IN REAL TIME

[75] Inventor: Junichi Minamitaka, Oume, Japan

[73] Assignee: Casio Computer Co., Ltd., Tokyo, Japan

[21] Appl. No.: 998,561

[22] Filed: Dec. 29, 1992

[30] Foreign Application Priority Data

Dec. 30, 1991 [JP] Japan ..... 3-360545
Dec. 30, 1991 [JP] Japan ..... 3-360546

[51] Int. Cl.[6] ..... G10H 7/00; G04B 13/00; A63H 5/00

[52] U.S. Cl. ..... 84/609; 84/612; 84/613; 84/636; 84/637

[58] Field of Search ..... 84/669, 609–614, 84/634–637, 650–652, 666–669

[56] References Cited

U.S. PATENT DOCUMENTS 4,399,731 8/1983 Aoki .
4,664,010 5/1987 Sestero .
4,926,737 5/1990 Minamitaka .
4,982,643 1/1991 Minamitaka ..... 84/613
5,003,860 4/1991 Minamitaka ..... 84/609
5,088,380 2/1992 Minamitaka ..... 84/637
5,099,740 3/1992 Minamitaka .
5,218,153 6/1993 Minamitaka ..... 84/613

FOREIGN PATENT DOCUMENTS 62-187876 8/1987 Japan .
WO86/05616 9/1986 WIPO .

*Primary Examiner*—William M. Shoop, Jr.
*Assistant Examiner*—Jeffrey W. Donels
*Attorney, Agent, or Firm*—Frishauf, Holtz, Goodman, Lager & Chick

[57] ABSTRACT

A composition conditioning system selects a music structure from a music structure database. The selected music structure specifies a first condition of music composition. A style input specifies a second condition of music composition. A melody rhythm composer retrieves, from a rhythm pattern database, an appropriate rhythm pattern for the composition condition. A chord progression composer retrieves, from a chord progression database, a suitable chord progression for the composition condition. A melody pitch composer generates a pitch candidate for a new melody note from an old melody note pitch and a current music progression (tonality and chord). A pattern recognizing module analyzes a melody up to the candidate into a melody pattern. A test module searches through a melody pattern rule base for the analyzed melody pattern.

13 Claims, 43 Drawing Sheets

CHORD TYPE
CHO(TYPE)

| MAJ | MIN | 7TH | MIN7 | MAJ7 |
|---|---|---|---|---|
| 0 | 1 | 2 | 3 | 4 |

CHORD ROOT OR KEY
CHO (ROOT),KEY

| C | C# | D | · · · · | B |
|---|---|---|---|---|
| 0 | 1 | 2 | · · · · | 11 |

MUSIC STRUCTURE(UPPER/LOWER)

STR1D

| AA | BB | CC | · · · · |
|---|---|---|---|
| 1H | 2H | 4H | · · · · |

STR2D

| aa | bb | cc | · · · · |
|---|---|---|---|
| 1H | 2H | 4H | · · · · |

RHYTHM STYLE
RHY

| ROCK | DISC | 16BE | SWIN | WALT |
|---|---|---|---|---|
| 1H | 2H | 4H | 8H | 10H |

FIG.4

PITCH DATA OR KEY CODE
PIT,KC

| C2 | C#2 | D2 | · · · · | B2 | C3 | C#3 | D3 | · · · · | B3 | · · · · |
|---|---|---|---|---|---|---|---|---|---|---|
| 0 | 1 | 2 | · · · · | 11 | 12 | 13 | 14 | · · · · | 23 | · · · · |

NOTE TYPE
NT

| CHOT | AVAI | SCAL | TENS | AVOI | END |
|---|---|---|---|---|---|
| 0 | 1 | 2 | 3 | 4 | fH |

MOTION
MT

| SAME | +STEP | -STEP | +JUMP | -JUMP | SEP |
|---|---|---|---|---|---|
| 0 | 1 | 2 | 3 | 4 | fH |

JDG

| NG | GOOD |
|---|---|
| 0 | 1 |

USER-MEL

| NO | YES |
|---|---|
| 0 | 1 |

FIG.5

PCS ELEMENTS
PCS(CT,TN,SN,AN,AV)

| C | C# | D | Eb | E | F | F# | · · · · | Bb | B |
|---|---|---|---|---|---|---|---|---|---|
| 1H | 2H | 4H | 8H | 10H | 20H | 40H | · · · · | 400H | 800H |

RHYTHM PATTERN ELEMENTS
PAT

| 0 | 1 | 2 | 3 | 4 | 5 | 6 | · · · · | 14 | 15 |
|---|---|---|---|---|---|---|---|---|---|
| 1H | 2H | 4H | 8H | 10H | 20H | 40H | · · · · | 4000H | 8000H |

BEAT STYLE

4BEAT : 1H,8BEAT : 2H,16BEAT : 4H

FIG.6

STANDARD PCS MEMORY
CHORD TONE CT

| ADDRESS | DATA | INDICATE |
|---|---|---|
| MAJ | 91H | C,E,G |
| MIN | 89H | C,Eb,G |
| 7TH | 491H | C,E,G,Bb |
| MIN7 | 489H | C,Eb,G,Bb |
| MAJ7 | 891H | C,E,G,B |

TENSION NOTE TN

| ADDRESS | DATA | INDICATE |
|---|---|---|
| MAJ | a44H | D,F#,A,B |
| MIN | 824H | D,F,B |
| 7TH | 34eH | Db,D,D#,F#,Ab,A |
| MIN7 | 824H | D,F,B |
| MAJ7 | 244H | D,F#,A |

SCALE NOTE SN

| ADDRESS | DATA | INDICATE |
|---|---|---|
| ROCK | ab5H | C,D,E,F,G,A,B |
| DISC | 6bcH | D,Eb,E,F,G,A,Bb |
| 16BE | 6b5H | C,D,E,F,G,A,Bb |
| SWIN | ab5H | C,D,E,F,G,A,B |
| WALT | ab5H | C,D,E,F,G,A,B |

FIG.7

FIXED MELODY PATTERN RULE BASE MEMORY MPM1

| ADDRESS | DATA | | | | INDICATE |
|---|---|---|---|---|---|
| MPM1 | CHOT +STEP | AVAI +STEP | CHOT SEP | | C A C |
| | CHOT -STEP | AVAI -STEP | CHOT SEP | | C A C |
| | CHOT +STEP | AVAI -JUMP | SCAL +STEP | CHOT SEP | S C C A |
| | END | | | | |

NOTE TYPE & MOTION MEMORY NTM,MTM

| ADDRESS | DATA | | | | INDICATE |
|---|---|---|---|---|---|
| NTM | CHOT | AVAI | CHOT | END | C A C |
| MTM | +STEP | -STEP | +STEP | END | |

FIG.8

TEMPO/BEAT MEMORY TBTM

| ADDRESS | DATA | COMMENTS |
|---|---|---|
| TBTM | 16BEAT 2 | TMP=O |
| | 16BEAT 2 | TMP=1 |
| | 8BEAT 1 | TMP=2 |
| | 8BEAT 1 | TMP=3 |
| | 4BEAT 0 | TMP=4 |

RANDOM NUMBER MEMORY RANM

| ADDRESS | DATA | |
|---|---|---|
| RANM | RANDOM NUMBER DATA | |
| | ffffH | END |

FIG.9

CHORD PROGRESSION DATABASE MEMORY CPM

| ADDRESS | DATA | | | COMMENTS |
|---|---|---|---|---|
| CPM | ********** | 00111 | | ATTRIBUTE(RHYTHM) |
| | 128 | ******* | 101 | ATTRIBUTE(LENGTH\|STRUCTURE) |
| | C | MAJ | 16 | ROOT\|TYPE\|LENGTH |
| | F | MAJ | 16 | |
| | E | MIN | 16 | |
| | A | MIN | 16 | |
| | D | MIN | 16 | |
| | G | 7TH | 16 | |
| | C | MAJ | 16 | |
| | C | MAJ | 16 | |
| | 0000H | | | SEPARATOR |
| | ********** | 00111 | | ATTRIBUTE(RHYTHM) |
| | 128 | ******* | 101 | ATTRIBUTE(LENGTH\|STRUCTURE) |
| | F | MAJ | 16 | ROOT\|TYPE\|LENGTH |
| | F | MAJ | 16 | |
| | E | MIN | 16 | |
| | A | 7TH | 16 | |
| | D | MIN | 16 | |
| | G | 7TH | 16 | |
| | C | MAJ | 16 | |
| | C | MAJ | 16 | |
| | ffffH | | | END MARK |

FIG.10

MUSIC STRUCTURE DATABASE MEMORY
(STR1 FOR HIGH LEVEL,STR2 FOR LOW LEVEL)

| ADDRESS | DATA | | | | COMMENTS |
|---|---|---|---|---|---|
| STR1 | AA | BB | AA | END | THREE PHRASES |
| | AA | BB | END | | TWO PHRASES |
| | AA | AA | BB | CC | FOUR PHRASES |
| | ffffH | | | | END MARK |

| ADDRESS | DATA | | | | COMMENTS |
|---|---|---|---|---|---|
| STR2 | ***1100 | | | | ATTRIBUTE(SUITABLE FOR PHASE CC OR DD) |
| | aa | bb | aa | aa | 8BARS(INTRAPHRASE STRUCTURE) |
| | bb | bb | cc | cc | |
| | ***1100 | | | | ATTRIBUTE(SUITABLE FOR PHASE CC OR DD) |
| | aa | aa | bb | bb | 8BARS(INTRAPHRASE STRUCTURE) |
| | bb | bb | cc | cc | |
| | ffffH | | | | END MARK |

FIG.11

RHYTHM PATTERN DATABASE MEMORY RPM

| ADDRESS | DATA | COMMENTS |
|---|---|---|
| RPM | **********00111 | ATTRIBUTE(RHYTHM) |
| | 8BEAT *******101 | ATTRIBUTE(BEAT\|STRUCTURE) |
| | 0001000100010001 | NOTE-ON PATTERN |
| | 1000100010001000 | NOTE-OFF PATTERN |
| | **********00111 | ATTRIBUTE(RHYTHM) |
| | 8BEAT *******110 | ATTRIBUTE(BEAT\|STRUCTURE) |
| | 0001010001010001 | NOTE-ON PATTERN |
| | 1000100010101000 | NOTE-OFF PATTERN |
| | ffffH | END MARK |

FIG.12

MPM2 : START ADDRESS OF ENTENDED MELODY PATTERN RULE BASE

MPM2SIZE : SIZE OF MPM2

MEAS : LENGTH OF ONE MEASURE

CP_C : CP LENGTH COUNTER

T : RHYTHM COUNTER

BAR : MEASURE COUNTER

TMP : TEMPO

BEAT : BEAT STYLE

STRD1 : SELECTED UPPER STRUCTURE

STRD2 : SELECTED LOWER STRUCTURE

PIT,PREV_PIT : PITCH DATA(CURRENT, PRECEDING)

FIG.13

STR1_P : UPPER STRUCTURE POINTER

STR2_P : LOWER STRUCTURE POINTER

STR1D_P : UPPER STRUCTURE ELEMENT COUNTER

STR2D_P : LOWER STRUCTURE ELEMENT COUNTER

RPM_P : RHYTHM PATTERN POINTER

CPM_P : CHORD PROGRESSION POINTER

CPMD_P : CHORD POINTER

RANM_P : RANDOM NUMBER DATA POINTER

MODE : MODE(NORMAL OR RMELODY)

KEYON : KEY STATE(YES FOR KEY ON,NO FOR KEY OFF)

PKEYON : PRECEDING KEY STATE(YES FOR KEY ON,NO FOR KEY OFF)

USER_MEL : WHETHER USER HAS PLAYED IN MEASURE

FIG.14

AUTOMATIC COMPOSER FOR COMPOSING A MELODY IN REAL TIME

BACKGROUND OF THE INVENTION

1. Field of the Invention

This invention relates to musical apparatus. In particular, the invent ion pertains to an automatic composer which automatically composes melody.

2. Description of the Prior Art

Several automatic composers are known which automatically compose a melody. Examples are disclosed in U.S. Pat. Nos. 4,399,731, 4,664,010, WO No. 86/05619 and Japanese Patent application laid-open SHO62-187876.

The automatic composer of U.S. Pat. No. 4,399,731 uses trial-and-error method which generates random numbers to compose a melody note pitch succession. Thus, the composer has an infinite space of melody composing but lacks knowledge or art of music composition so that the chance of getting a good melody is too low.

Each automatic composer of U.S. Pat. No. 4,664,010 and WO No. 86/05619 is a melody composer or transformer which transforms a given melody. The melody transformation involves a mathematical operation (mirror transformation of a pitch succession, linear transformation of a two dimensional space of pitch and durational series). With a limited space of the transformation, the composer has only a fixed and mathematical (rather than musical) capability of melody composition.

Japanese patent application laid-open SHO 62-187876 discloses a melody composer which utilizes a Markov chain model to generate a pitch succession. The apparatus composes a melody based on a pitch transition table indicative of a Markov chain of a pitch succession. The composed melody has a musical style of the pitch transition table. While it can compose a musical melody at a relatively high efficiency, the composer provides a small space of melody composition since the composed melody style is limited.

Common disadvantages of the prior art described above are (1) no capability of analyzing or evaluating a melody, (2) no use of melody analyzed results for melody composition and thus (3) low capability of composing a musical melody.

In view of these, the present inventor proposed an automatic composer which utilizes a melody analyzing and evaluating capability for melody composition, as disclosed in U.S. Pat. No. 4,926,737 and U.S. Pat. No. 5,099,740 (divided from U.S. Pat. No. 4,926,737). The automatic composer has a stored knowledge-base of melody which classifies nonharmonic tones by their relationship formed with harmonic tones based on the premise that a melody is a mixed succession of harmonic and nonharmonic tones. The stored knowledge-base of nonharmonic tone classification is used to analyze a melody (motive) supplied by a user. It is also used to compose or synthesize a melody. The melody composition involves two steps. The first step generates a harmonic tone succession or arpeggio by embodying an arpeggio featuring pattern (developed from the motive) according to a musical progression (a chord in progression). The second step generates nonharmonic tones and places them in the harmonic tone succession. Nonharmonic tones are generated by embodying a nonharmonic tone featuring pattern developed from the motive according to a musical progression (a scale in progression) and the stored knowledge of nonharmonic tone classification. Whereas it can compose a musical melody reflecting a feature of the motive, the automatic composer has the following disadvantages.

(a) The preprocess to the melody composition involving analyzing a motive and creating an idea (arpeggio and nonharmonic tone featuring patterns) of a melody to be composed requires a considerable amount of data processing.

(b) The double-step melody composing is different from a human process of composing a melody. Thus, the automatic composer fails to realize a faithful Artificial Intelligence of musical composition.

(c) It is difficult to compose a melody in real time due to the preprocess and the double-step melody composing. In fact, the automatic composer is designed to compose a melody in non-real time on a measure by measure basis. After completing melody composition, the apparatus plays the composed melody by a tone generator. Should a melody idea (arpeggio and nonharmonic tone featuring pattern) be given in advance, a real-time melody composition would still be unfeasible. This is because the tasks of realizing the melody idea (double-step melody composing) are concentrated at a particular time such as a bar line time. This would result in a lag of the automatic performance (e.g., delay of a melody tone sounding) when the (computer) tasks are concentrated.

(d) A chord progression must be supplied from an input device to the automatic composer. This is not easy for those users having no or little knowledge of music.

(e) The automatic composer must be supplied with a motif and a chord progression which should be an fundamental part of the musical composition.

It is, therefore, desired that an automatic composer can:

(A) compose a musical melody in a single step, and (B) compose and play a melody in real time.

The automatic composer of U.S. Pat. Nos. 4,926,737 and 5,099,740 also discloses a rhythm generator which generates a rhythm of a melody by modifying an original rhythm (motive rhythm). The rhythm modification involves inserting and/or deleting note-on timings into or from the original rhythm according to rhythm control data called pulse scale having weights for individual timings in a musical time interval such as a measure.

The rhythm generator has a limited capability of generating rhythm patterns. It is difficult to generate those rhythm patterns which have the same tone number but are different in a subtle way from each other.

SUMMARY OF THE INVENTION

Therefore, a primary object of the invention is to provide an automatic composer having the total capability of composing a musical melody and response performance at a level unattainable by the prior art.

Another object of the invention is to provide an automatic composer capable of composing a musical melody in a single step by the support of music analyzing and evaluating capability. A further object of the invention is to provide an automatic composer capable of composing and playing a melody on a real-time bais.

A specific object of the invention is to provide an automatic composer capable of quickly composing a music piece meeting the composition condition set by a user.

Another specific object of the invention is to provide an automatic composer capable of composing a melody having a natural rhythm desired by a user without requiring large amount of data processing.

A further specific object of the invention is to provide an automatic composer capable of making a chord progression natural and desired by a user with high efficiency and without requiring any particular knowledge on the part of the user.

In accordance with an aspect of the invention, there is provided an automatic composer which comprises music progression providing means for providing a music progression, melody pattern rule base means for storing rules of melody patterns each representing a melody note succession by a note type succession and a motion succession, and melody composing means for composing a melody fitting with the music progression from the music progression providing means and satisfying rules of melody patterns in the melody pattern rule base means.

With this arrangement, a melody is composed in a single step rather than double steps in which the first step generates a harmonic tone succession and the second step generates a nonharmonic tone succession for mixing into the harmonic tone succession. Since a composed melody fits with a music progression representing melody background and accords with melody pattern rules stored in the melody pattern rule base means, this arrangement can provide a musically desirable melody with a relatively high efficiency. This means that analysis of a composed melody by its musical background (music progression) would reveal a feature of the melody which is represented by a note type succession and a motion succession and satisfies a stored melody pattern rule or rules. In other words, realizing the melody pattern rules according to musical background of a melody to be composed results in a composed melody. Further this arrangement makes it feasible to compose and perform a melody in real-time since it requires only a small amount of data processing for melody composition, which amount is only a fraction of that required by the prior-art automatic composer of U.S. Pat. Nos. 4,926,137 and 5,099,740 stated earlier.

An embodiment of the real-time composer further comprises tempo designating means for designating a performance tempo. The melody composing means comprises real-time melody composing means for composing a melody in real-time in commensurate with the performance tempo. The real-time composer further comprises real-time melody performing means for performing in real time as sounds the melody composed by the real-time melody composing means.

For a real-time composer with real-time melody performing capability, (a) an overhead time from the composition start command from a user to the start of the melody performance must be minimized and (b) the melody performance must keep the intended tempo. To this end, the composer should "time-distribute" the process of melody composing to avoid momentary concentration of data processing. This can be done by limiting a number of melody notes composed at a time to a single note, for example. Thus, the sequential determining or composing of melody notes is effective for real-time melody composition. This does not necessarily mean, however, that the real-time composer composes and performes a melody note each time when a note-on time has come.

In an embodiment of the automatic composer which composes melody notes sequentially (in order of time), the melody composing means may comprise melody pattern storage means for storing a melody pattern represented in a note type succession and a motion succession and ending with an old melody note, pitch candidate generating means for generating a first pitch candidate of a new melody note to be newly composed, classifying means for classifying a note type and motion of the first pitch candidate based on the pitch of the old melody note and a current situation of the music progression, test pattern forming means for using the classified note type and motion of the first pitch candidate to update the melody pattern storage means to thereby form a test melody pattern ending with the new melody note having the first pitch candidate, rule base search means for searching through the melody pattern rule base means for the test melody pattern, further candidate generating means responsive to failure of the rule base search means for generating a further pitch candidate of the new melody note, repeating means for repeating operation of the classifying means, the test melody pattern forming means and the rule base search means for the further pitch candidate, and pitch determining means responsive to success of the rule base search means for determining a pitch of the new melody note which is specified by the pitch candidate involved in the success of the rule base search means.

The music progression providing means may comprise chord progression generating means for generating a chord progression and tonality designating means for designating a tonality (key, scale).

A further aspect of the invention provides an automatic composer with a feature of extending the melody pattern rule base by utilizing a melody supplied from a user.

In an embodiment, the automatic composer with the rule base extending feature comprises user melody input means for inputting a melody from a user, melody pattern recognizing means for recognizing a pattern of the input melody based on the music progression to thereby form a recognized melody pattern which is represented in a note type succession and a motion succession, and rule base extending means for adding the recognized melody pattern to the melody pattern rule base means as an additional rule to thereby extend to melody pattern rule base.

This arrangement provides an automatic composes with an increased capability of composing melodies meeting user's preferences, and enables a user to take positive part in musical composition.

There may be provided melody pattern rule bases which are grouped by musical styles. To save storage capacity, the whole melody pattern rule base may be subdivided into groups such that each melody pattern group is linked with a group of appropriate musical styles to thereby share the storage.

A further aspect of the invention provides an automatic composer which comprises music progression providing means for providing a music progression, melody pattern rule base means for storing rules (rule base) of melody patterns each represented in a note type succession and a motion succession, note succession candidate generating means for generating a note succession candidate for a melody, melody pattern forming means for recognizing a pattern of the note succession candidate based on the music progression to thereby form a test melody pattern represented in a note type succession and a motion succession, rule base search means for searching through the melody pattern rule base means for the test melody pattern, repeating means for repeating operation of the note succession candidate generating means, the melody pattern forming means and the rule base searching means while the note succession candidate is changed each time till success of the rule base search means in finding a melody pattern rule matching the test melody pattern, and determining means responsive to the success of the rule base search means for determining the note succession candidate involved in the success of the rule base search means as a note succession of the melody.

With this arrangement, the composer can determine or compose two or more melody notes at a time.

A further aspect of the invention provides an automatic composer for composing a melody which comprises musical material database means for storing a database of musical materials for music composition, condition setting means for setting conditions of music composition, search means for searching through the musical material database means for those musical materials meeting the set conditions of music composition, and composing means for composing the searched musical materials as part of the music composition.

With this arrangement, those musical materials (e.g., rhythm, chord progression) meeting the conditions of music composition can be provided as part of the music composition. The arrangement does not require a large amount of data processing, thus realizing a quick (e.g., full real-time) system response.

The search means may comprise access means for accessing to the musical material database means to retrieve a musical material, testing means for testing the retrieved musical material to see whether the retrieved musical material meets the set conditions of musical composition, and repeating means for repeating operation of the access means and the test means while causing the access means to retrieve a different musical material each time until the test means finds a musical material meeting the set conditions of musical composition.

In an embodiment, an automatic composer for composing a melody comprises rhythm pattern database means for storing a database of rhythm patterns, attribute setting means for setting a desired attribute of a melody note durational succession, and melody rhythm composing means for retrieving from the rhythm pattern database means, a rhythm pattern having the desired attribute to thereby compose a melody note durational succession. In comparison with the pulse-scale based melody rhythm composing technique disclosed in U.S. Pat. Nos. 4,926,737 and 5,099,740, this arrangement can greatly reduce the amount of data to be processed for composing the melody rhythm, A composed melody rhythm (durational succession) is retrieved from the rhythm pattern database means. This assures naturalness of the composed melody rhythm. In addition, the arrangement can efficiently provide a melody rhythm in commensurate with user's intention given by the attribute setting means.

In an embodiment, the attribute setting means comprises style setting means for setting a desired musical style, and structure setting means for setting a desired musical structure. The melody rhythm composing means comprises access means for accessing to the rhythm pattern database means to retrieve a rhythm pattern, attribute test means for testing the retrieved rhythm pattern to see whether it meets the desired musical style and the desired musical structure, repeating means for repeating operation of the access means and the attribute test means while causing the access means to retrieve a different rhythm pattern each time until the test means finds a satisfactory rhythm pattern, and determining means for determining the satisfactory rhythm pattern as the melody note durational succession.

In a preferred data format, rhythm pattern data stored in the rhythm pattern database means may contain attribute information in addition with note on and off timing information. This format avoids duplicated records of the same rhythm pattern, thus reduces the total storage capacity and facilitates the attribute testing and the database organizing.

A further aspect of the invention provides an automatic composer for composing a melody and a chord progression which comprises chord progression database means for storing a database of chord progressions, attribute setting means for setting a desired attribute of a chord progression to be composed, and chord progression composing means for retrieving, from the chord progression database means, a chord progression having the desired attribute to thereby compose a chord progression.

This arrangement can efficiently provide chord progressions which are natural, having a wide variety and according with the user's request.

BRIEF DESCRIPTION OF THE DRAWINGS

The above and other objects, features and advantages of the invention will become more apparent from the following description taken in connection with the accompanying drawings in which:

FIG. 4 shows memonic and numerical representation of musical elements used in an embodiment of the invent ion;

FIG. 5 shows mnemonic and numerical representation of further musical elements;

FIG. 6 shows mnemonic and numerical representation of still further musical elements;

FIG. 7 shows a standard PCS memory for chord, tension and scale notes;

FIG. 8 shows a fixed melody pattern rule base memory and a note type and motion memory;

FIG. 9 shows a tempo/beat memory and a random number memory;

FIG. 10 shows a chord progression database memory;

FIG. 11 shows a music structure database memory;

FIG. 12 shows a rhythm pattern database memory;

FIG. 13 show further constants and variables used in the embodiment;

FIG. 14 shows still further variables;

FIG. 25 is a flow chart of PROCESS KEY ON;

FIG. 27 is a flow chart of TASK AT KEY ON;

FIG. 33 is a flow chart of TASK AT NOTE ON;

DETAILED DESCRIPTION OF THE PREFERRED EMBODIMENTS

Figure 1A:
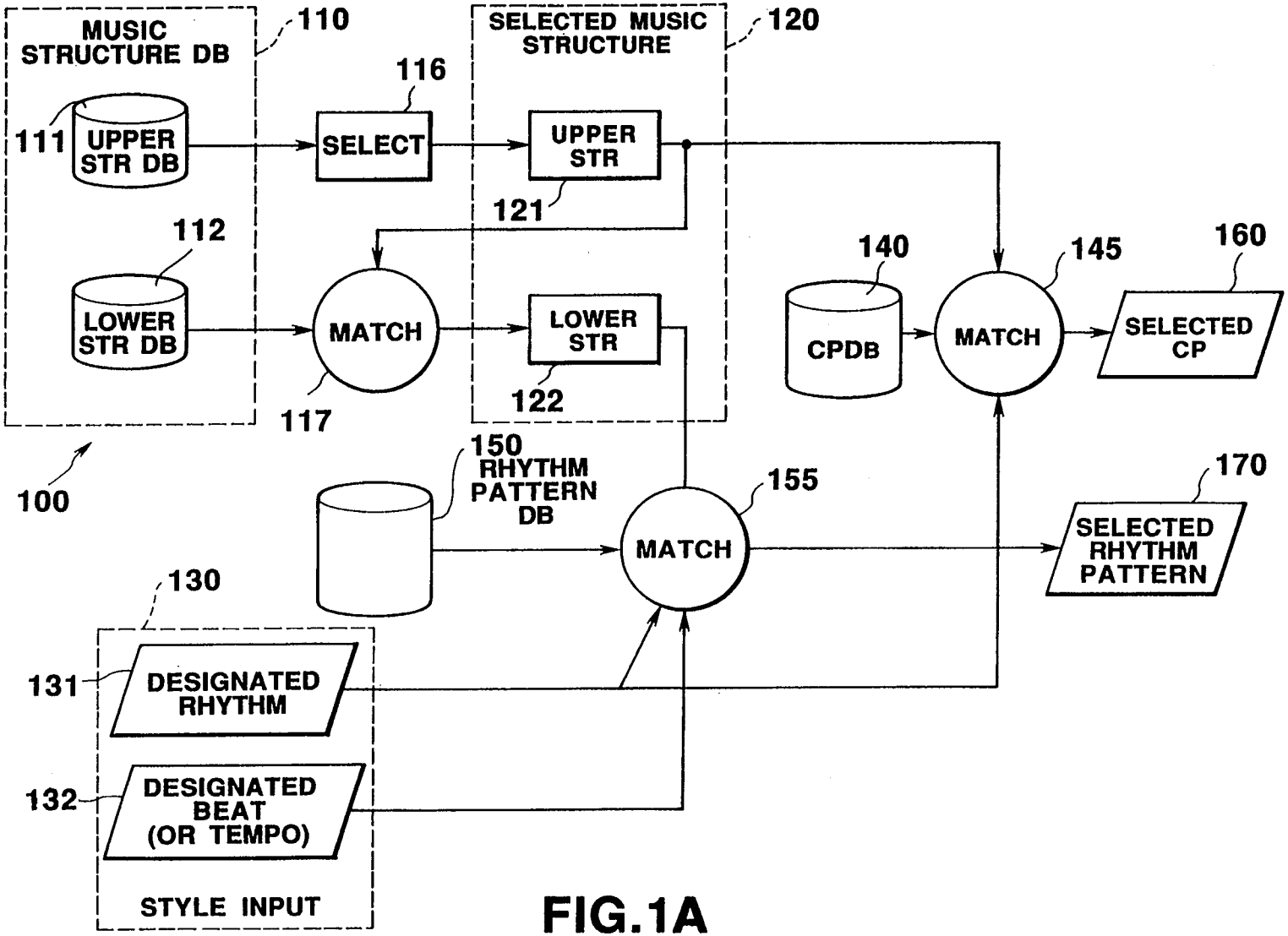
FIG. 1A is a functional block diagram of a music composition conditioning system incorporated in an automatic composer of the invention.

The invention will be described in more detail with respect to an embodiment of an automatic composer by referring to the drawings.

Features

The automatic composer of the embodiment has primary features of conditioning music composition, composing a melody note pitch succession and extending a melody pattern rule base. These features will now be described in greater detail.

Music Composition Conditioning Feature (FIG. 1A)

FIG. 1A is a functional block diagram showing a music composition conditioning system (music conditioner) 100 incorporated in the automatic composer of the embodiment. The music conditioner 100 generates a chord progression (CP) 160 which is selected based on a music structure database 110 and a chord progression database (CPDB) 140. The music conditioner 100 also generates a selected rhythm pattern 170 based on the musical structure database 110, a musical style input 130 and a rhythm pattern database 150.

A succession of selected CPs 160 indicates a chord progression of a music piece to be composed. A succession of selected rhythm patterns 170 indicates a rhythm (note durational succession) of a melody to be composed. Each selected CP is retrieved from CPDB 140 and has an desired attribute suitable for a music structure 120 selected from the music structure database 110. Each selected rhythm pattern is retrieved from the rhythm pattern database 150 and fits with the selected music structure 120 and the style input 130.

In FIG. 1A, the music structure database 110 comprises an upper structure database 111 and a lower structure database 112. The upper structure database memory 111 stores a database of musical structures at a high level (e.g., phrase level). The lower structure database memory 112 stores a database of musical structures at a low level (e.g., internal structures of phrase). Assuming, for example, that each phrase has a length of eight measures, each structure entry in the lower structure database 112 contains information on an eight-measure structure. A selecting module 116 retrieves an upper structure from the upper structure database 112. The retrieved upper structure is stored as a selected upper structure 121. A match module 117 retrieves, from CPDB 140, a chord progression appropriate for the selected upper structure 121 to thereby generate a selected chord progression 160.

A second match module 117 retrieves, from the lower structure database 112, a lower structure (e.g., eight-measure structure) complying with the selected upper structure. The retrieved lower structure is stored as a selected lower structure 122. The selected low structure 112 is supplied to a third match module 155 for attribute test of a rhythm pattern.

The style input 130 comprises a designated rhythm style 131 and a designated beat style or ttempo 132. These inputs 131 and 132 are supplied to the match module 155 for the attribute test.

The match module 155 searches through the rhythm pattern database 150 for a rhythm pattern having an attribute appropriate for the lower structure 122 selected from the lower structure database 112 and also appropriate for the style input 130 of the designated rhythm 131 and designated beat (or tempo) 132 to thereby generate a selected rhythm pattern 170.

The selected rhythm pattern defines a note durational succession of an automatically composed melody, thus specifying melody note on and off timings.

In this manner, the music conditioner 100 generates, as part of music composition, music materials (selected chord progression and selected rhythm pattern) which are appropriately conditioned by the style input 130 from a user while utilizing the databases as musical knowledge sources.

Since the melody note durational succession has been obtained from the selected rhythm patterns 170, the melody composing process will be finished by generating a melody note pitch succession.

The music structure database 110 of FIG. 1A has two hierarchic levels of upper (high) and lower (low) for the music structure. It may be modified to have a single, or three or more levels of hierarchy. Thus, the selected music structure may also take any number of hierarchic levels. In FIG. 1A, the style input 130 is given by a designated rhythm 131 and a designated beat or tempo 132. However, other musical style parameters may be used for the style input.

Figure 1B:
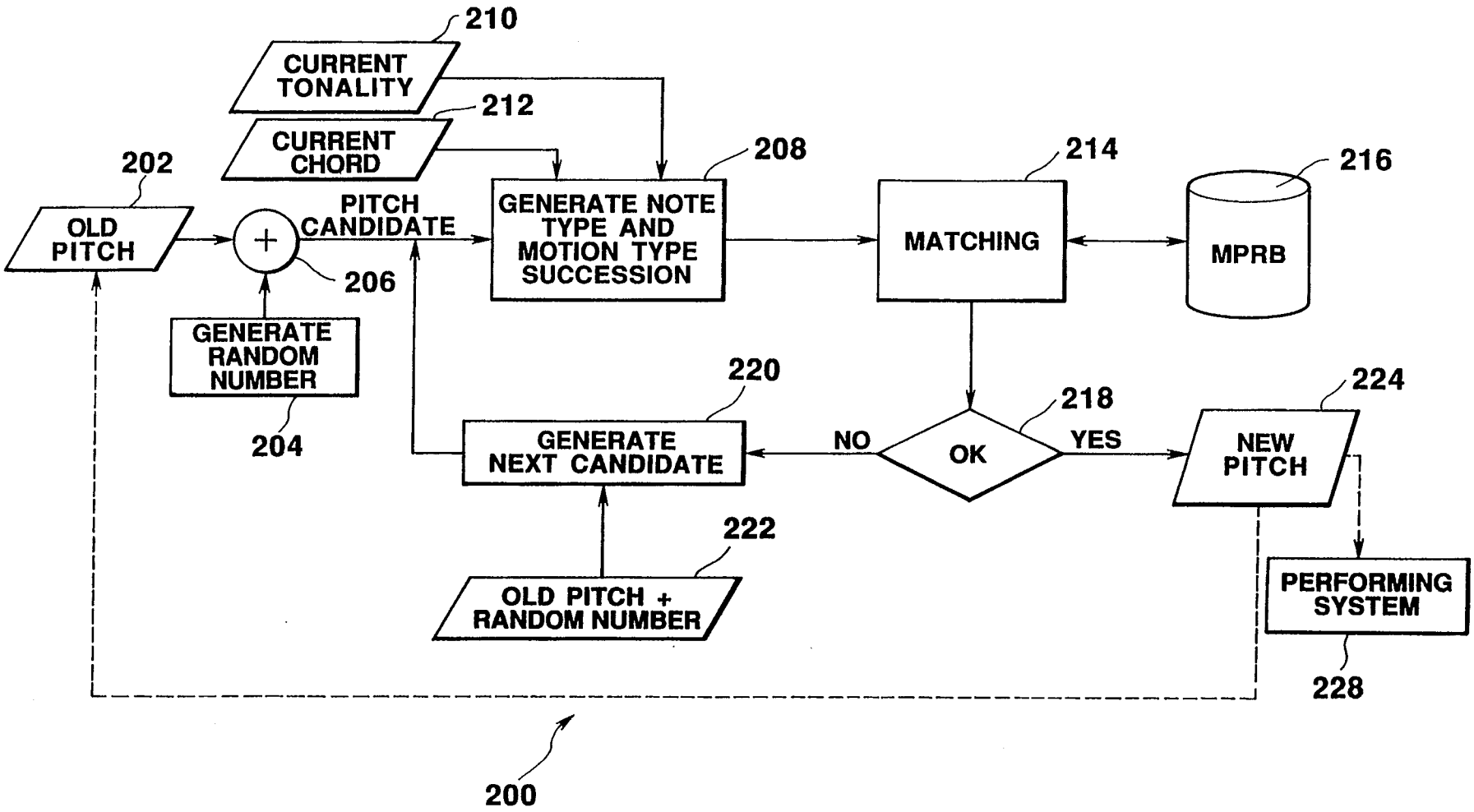
FIG. 1B is a functional block diagram of a real-time melody note pitch succession generator incorporated in the automatic composer.

Pitch Succession Generator (FIG. 1B)

FIG. 1B shows a functional block diagram of a melody note pitch succession generator 200 incorporated in the present automatic composer. The pitch succession generator 200 composes or generates a pitch succession of melody notes. The pitch succession generator 200 may be combined with the music conditioner 100 of FIG. 1A (through not restricted). In such combination, the pitch succession generator 200 generates a new pitch 224 of melody each time when a melody note-on timing is signaled from the selected rhythm pattern 170. A succession of generated (determined) pitches 224 defines a melody note pitch succession.

To determine a new pitch, the pitch succession generator 200 causes an adder 206 to add a random number from a random number generator 204 to an old (previous) pitch 202 to thereby generate a first candidate for the new pitch in a Markov process. The new pitch candidate is supplied to a note type and motion succession generating module 208. The module 208 analyzes a note succession formed with a generated pitch succession and the new pitch candidate as the last element of the succession to obtain a classified note type and motion succession. For the classification of note type and motion, the module 208 utilizes a current tonality 210 (key and scale) and a current chord 212. The output of the module 208 indicates a pattern of the melody note succession up to the new pitch candidate, and is supplied to a matching module 214.

The matching module 214 searches through a melody pattern rule base (MPRB) 216 for the melody pattern supplied from the note type and motion succession generating module 208. If the search fails to find an entry in MPRB 216 matching the supplied melody pattern, a box 218 yields NO, causing a next candidate generator 220 to generate a next candidate for the new pitch. The next candidate is determined by the old pitch plus random number, as indicated in box 222. For the next candidate, the note type and motion succession generating module 208 and the matching module 214 repeat the operation. If MPRB 216 contains an entry matching the output from the note type and motion succession Generating module 208, the decision box 218 yields YES so that the candidate involved in the successful search determines the new pitch 224. The determined pitch 224 will become an old pitch 202 when the pitch succession generator 200 generates a next melody pitch by repeating the operation.

In this manner, the pitch succession generator 200 composes melody pitches successively in real time. The pitch succession Generator output 224 may be supplied to a real-time performing system 228 (including an electronically operated tone generator), thus enabling simultaneous composing and playing in real time. As noted, the pitch succession Generator 200 has a real-time composing capability.

Figure 1C:
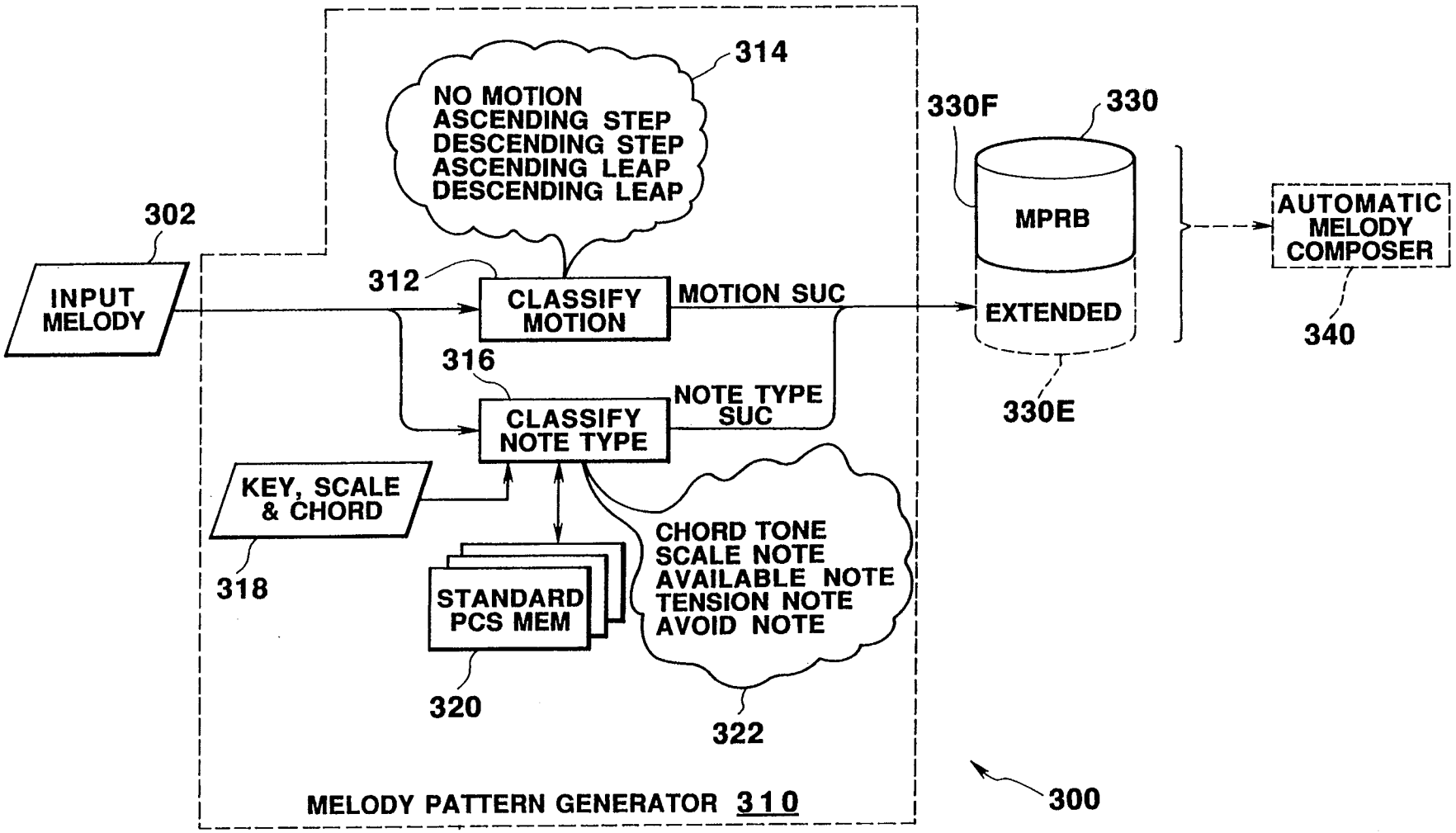
FIG. 1C is a functional block diagram of a melody pattern rule base extending system incorporated in the automatic composer.

MPRB Extending Feature (FIG. 1C)

FIG. 1C shows a functional block diagram of a melody pattern rule base (MPRB) extending system 300. MPRB extending system 300 functions to extend the melody pattern rule base (MPRB) 330 to be used by an automatic melody composer 340 such as the pitch succession generator shown in FIG. 1B. A first portion 330F of MPRB 330 indicates a fixed melody pattern rule base permanently built in the automatic composer. A second portion 330E of MPRB 330 forms an extension of MPRB. In accordance with the invention, MPRB extending system 300 makes, from input melody 302 from a user, a melody pattern rule for the extension 330E. It is the melody pattern Generator 310 which makes such rules.

The input melody 302 is supplied to a motion classifying module 312 and a note type classifying module 316 in the melody pattern Generator 310. The motion classifying module 312 evaluates pitch intervals between notes in the input melody to thereby form a motion succession.

For example, the module 312 classtries a melody note motion into no motion, ascending step, descending step, ascending leap or descending leap, as indicated in 314. The note type classifying module 316 classtries a note type of an input melody note for forming a note type succession. For the note-type classification, the module 316 utilizes musical background information 316 on key, scale and chord, and a standard pitch class set (PCS) memory 320 which stores a PCS for each note type. For example, the module 316 classifies a melody note into a type of chord tone, scale note, availablle note, tension note or avoid note, as indicated in 322.

The motion succession output from the motion classifying module 312 and the note type succession output from the note type classifying module 316 indicate a pattern of the input melody 302, or describe a melody pattern rule derived from the input melody. The derived melody pattern rule is recorded in the extension 330E of MPRB memory 330. In the melody composing operation, the automatic melody composer 340 (e.g., pitch succession generator 200 of FIG. 1B) utilizes the entire MPRB 330 including both fixed and extended portions 330F and 330E.

The automatic composer having MPRB extending system 300 can efficiently provide a satisfactory melody to a user.

Figure 2:
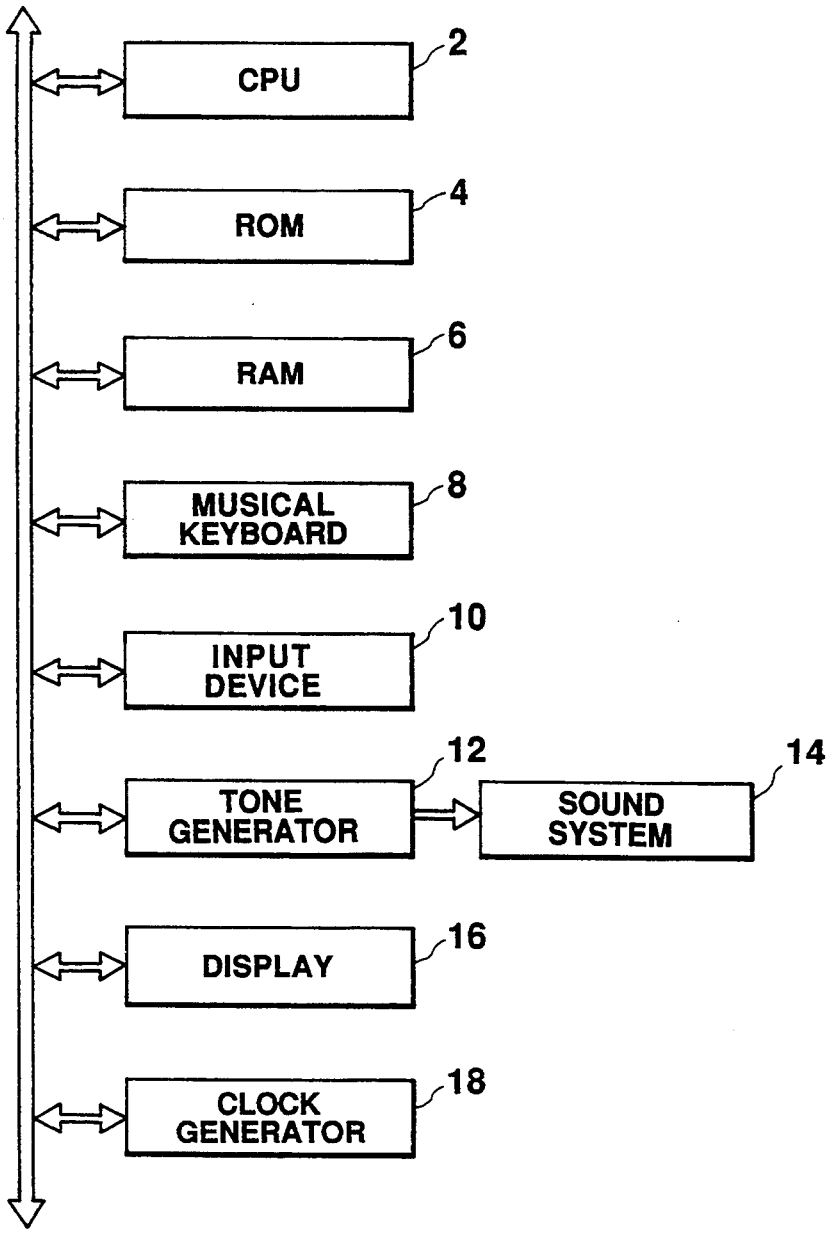
FIG. 2 is a block diagram showing a representative hardware arrangement of an automatic composer of the invention.

Hardware Organization (FIG. 2)

FIG. 2 shows a representative hardware organization of the automatic composer having the features described in conjunction with FIGS. 1A–1C.

CPU 2 controls the entire system according to programs stored in ROM 4. In addition to the programs, ROM 4 further stores various permanent data (e.g., the databases stated earlier). RAM 6 serves as a working memory and stores various variables and temporary data. A musical keyboard 8 may take the form of a conventional electronic musical keyboard and is used to play or input a melody from a user. An input device 10 includes a musical style input device, keys for starting and stopping automatic composition etc. CPU 2 periodically scans the keyboard 8 and the input device 10 to perform appropriate processes. A tone generator 12 generates a tone signal under the control of CPU 2. A sound system 14 receives the tone signal and reproduces a sound. A display device 16 may include a LED display and/or LCD display. A clock generator 18 generates an interrupt-request pulse each time when a music resolution time has passed, causing CPU 2 to call an interrupt routine to be described later in conjunction with FIG. 16.

Figure 3:
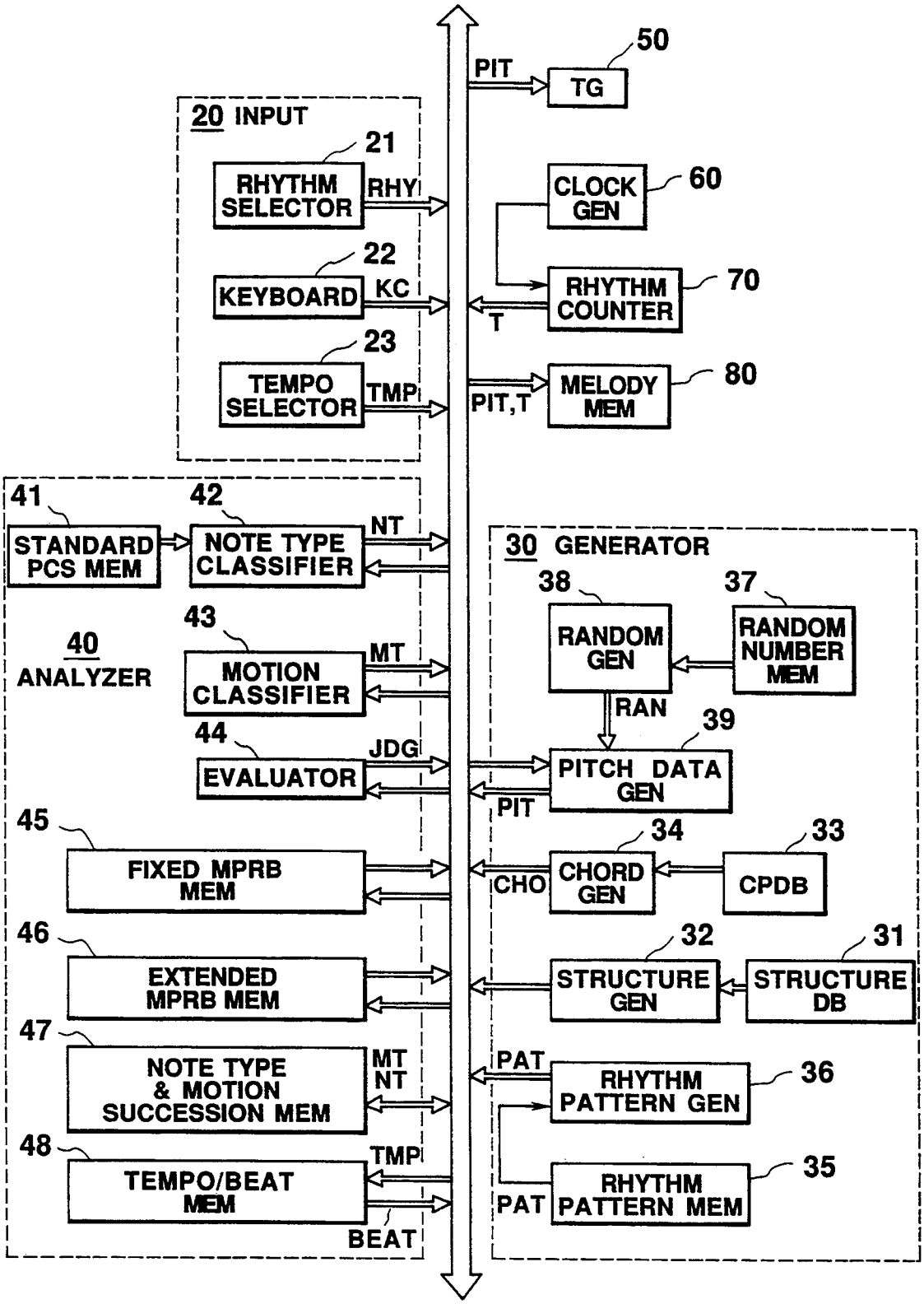
FIG. 3 is a functional block diagram of an automatic melody composing system incorporated in the automatic composer of FIG. 2.

Automatic Melody Composing Feature(FIG. 3)

FIG. 3 shows a functional block diagram of the automatic melody composer incorporated in the apparatus of FIG. 2. The automatic melody composer includes an input device 20 for inputting musical information required for melody composing, a generator 30 for generating musical data, an analyzer 40 for analyzing a composed melody, a clock generator 60, a rhythm counter 70, a melody memory 80, and a tone generator (TG) 50.

The input device 20 includes a rhythm selector 21 for selecting a rhythm style RHY, a musical keyboard 22 for inputting key codes KC, and a tempo selector 23 for setting a tempo TMP. Though not shown, the input device further includes means for starting and stopping the automatic melody composing process.

In the generator block 30, a structure generator 32 retrieves a musical structure from music structure database 31. The retrieved (selected) structure data contains high and low level structure data items. A chord generator 34 retrieves, from a chord progression database (CPDB) 33, a chord progression fitting with the selected music structure, and outputs a chord CHO prevailing at a current time T given by the rhythm counter 70. A rhythm pattern generator 36 retrieves, from a rhythm pattern database 35, a rhythm pattern PAT appropriate for the chord progression and the style input specified by the selected rhythm style RHY and tempo TMP. Specifically, the selected tempo TMP is converted to a beat style BEAT by a tempo/beat memory 48. The beat style BEAT is supplied to the rhythm pattern generator 36 to condition a rhythm pattern PAT to be generated.

Thus, the chord generator 34, structure generator 32 and rhythm pattern generator 36 each have a function of the matching (attribute testing) described in conjunction with FIG. 1A.

A random generator 38 retrieves a random number RAN from a random number data memory 37 and supplies it to a pitch data generator 39. The pitch data generator 39 generates pitch data PIT of a new melody note from old note pitch data and the random number RAN.

In the analyzer 40, a note type classifier receives the key, the selected rhythm style RHY and pitch data (PIT from the pitch data generator 39 or KC from the keyboard 22), and classifies its note type NT by referencing a standard pitch class set (PCS) memory 41. A motion classifier 43 classifies a motion MT from the old note to the new note (candidate). The outputs NT, MT from the classifiers 42 and 43 are stored in a note type and motion succession memory 47. A fixed melody pattern rule base (MPRB) 45 resides in ROM 4 in FIG. 2. An extended MPRB 46 resides in RAM 5 for the extension of MPRB. The analyzer 40 searches through the fixed and extended MPRBs 45 and 46 for the note type and motion succession (test melody pattern) from the memory 47. If the search has succeeded in finding a matching rule in MPRBs, a judgement flag JDG indicates OK, thus determining the new note pitch.

The rhythm counter 70 counts clock pulses (supplied at musical resolution timings from the clock generator 50) to output current time data T. The melody memory 80 stores data of a composed melody in the form of a pitch PT and time T succession. The tone generator 50 receives pitch data PIT at each timing of a melody note to thereby generate a corresponding tone signal.

Representation of Musical Elements (FIGS. 4–6)

In the following description (of flow charts, in particular), various musical elements are normally represented by mnenomics, or by numbers when required. Correspondence between mnemonic and numeric (machine-level) representations of musical elements will now be described with reference to FIGS. 4–6.

The mnemonic representation of chord type is CHO (TYPE). The numeric representation of chord type instances are such that a number "0" for chord type MAJ (major), "1" for MIN (minor), "2" for 7th, "3" for MINT and "4" for MAJ7. The data length of chord type is 6 bits, for example, by which up to 64 chord types can be represented. The mnemonic representation of chord root and key is CHO (ROOT) and KEY, respectively. The chord root and key is specified by their pitch class. Pitch class C is numerically represented by "0", C# by "1" and so on until B by "11." Thus, the effective data length of chord root and key is 4 bits. In the music structure, a high-level structure is mnemonically represented by STR1D, while a low-level structure is represented by STR2D. A high-level structure symbol AA is numerically represented by "1H", BB by "2H", CC by "4H" and so on. A low-level structure symbol aa is represented by a numer "1H", bb by "2H", cc by "4H" and so on. In the automatic composer of the embodiment, the effective length of structure data is 4 bits or a nibble. Rhythm style is mnemonically represented by RHY. A rhythm style ROCK is numerically represented by "1H", DISC (disco) by "2H", 16 BE (sixteen beats) by "4H", SWIN (swing) by "8H", and WALT (waltz) by "10H." Pitch and keycode are represented by PIT and KC, respectively. Pitch and keycode is specified by a pitch class and an octave. In the embodiment, a number "0" stands for C2 (pitch class C and second octave), and a number is succesively incremented as the pitch ascends by semitone steps.

The mnemonic of note type is NT. A note type CHOT (chord tone) is represented by a number "0", AVAI (available note) by "1", SCAL (scale note) by "2", TENS (tension note) by "3", AVOI (avoid note) by "4" and END (end mark) by FH. The mnemonic of motion is MT. SAME (no motion) is represented by a number "0", +STEP (ascending stepwise motion) by "1", −STEP (descending stepwise motion) by "2", +JUMP (ascending leap or jump motion) by "3", −JUMP (descending jump motion) by "4", and SEP (separating mark) by FH. JDG represents a judgement flag. NG (negative) judgement is numerically represented by "0" while GOOD judgement by "1." USERMEL is a user melody input flag. NO (absence of user melody input) is numerically represented by "0" while YES (presence of user melody input by "1".

Elements (i.e., pitch classes) of PCS (pitch class set) are represented as foolows; Pitch class C by 1H, C# by 2H D by 4H and so on until pitch class B is represented by 800H. Specifically, a bit position in a 12-bit word represent a corresponding pitch class when the bit has "1" value. For example, bit 0 with "1" value indicates pitch class C. A pitch class set is represented by a 12-bit word obtained from bit-by-bit ORing of its pitch class elements (represented by 12-bit words). For example, pitch class set of C and D pitch classes is represented by 5H obtained from logic ORing of 1H and 4H. PCS(CT), PCS(TN), PCS(SN), PCS(AN), and PCS(AV) are mnemonics of pitch class set (PCS) of chord tones, PCS of tension notes, PCS of scale notes, PCS of available notes, and PCS of avoid notes, respectively. Mnemonic of rhythm pattern is PAT. A rhythm pattern element is represented by a 16 bit word in which the sixteen bit positions indicate sixteen and equally spaced timings in a measure. A rhythm pattern is represented by a note-on pattern and a note-off pattern. Note-on pattern indicates note-on timings in a measure while note-off pattern indicates note-off timings. A note-on or off timing at a bar line is numerically represented by 1H. A note-on or off timing at 1/16 measure after the bar line is represented by 21H, and so on. A note-on or off pattern is a set of note-on or off timing elements and is thus obtained from bit-by-bit ORing of 16 bit words of the timing elements. For example, in a four-four time (four beats/measure) music, a note-on pattern having note-on timings at the first and second beats is represented by 11H obtained from logic ORing of 1H and 10H.

Data Memories (FIGS. 7–14)

FIGS. 7–14 illustrate various data memories. Each data word length is sixteen bits. Same symbol is used to represent a data memory and its start address. For example, a chord progression data memory is called by CPM. The same symbol also represents the start address of the chord progression database memory.

FIG. 7 illustrates a standard pitch class set (PCS) memory. The standard PCS memory comprises a chord tone memory CT, a tension note memory TN and a scale note memory SN.

The chord tone memory CT is a look-up table which receives (is addressed by) a chord type and returns a standard PCS of that chord type. For example, data "91H" stored in the chord tone memory CT at the symbolic address MAJ indicates that pitch classes C, E and G constitute the standard PCS of chord type MAJ. Standard PCS refers to a pitch class set determined with the reference chord root C. To state it another way, standard PCS data defines the intervalic structure of pitch class set of a chord type.

The tension note memory TN is a look-up table which is addressed by a chord type to return the standard PCS of tension notes built on the chord type. For example, when looked up by chord type MAJ, the tension note memory TN returns data A4 H indicative of the standard PCS having members D, F#, A and B.

The scale note memory SN is addressed by a rhythm style (or scale style) to return the standard PCS of scale notes. For example, when looked up by rhythm style ROCK, the scale note memory SN returns data AB5H. This indicates that the standard PCS of scale notes for ROCK is made up of pitch classes C, B, E, F, G, A and B.

FIG. 8 illustrates the fixed melody pattern rule base memory MPM1, and note type and motion memory NTM and MTM. The fixed melody pattern database memory MPM1 resides in ROM 4 in FIG. 2. The memory MTM1 realizes a rule base of melody patterns. Each rule is represented by two words (32 bits) in which the first word indicates a note type succession and the second word indicates a motion succession. For example, the first rule in the memory MPM1 describes a melody pattern beginning with a chord tone CHOT, moving to an available note AVAI by an ascending step STEP, and moving to a chord tone CHOT by an ascending stepwise motion +STEP. In the two-word rule data, each note type (e.g., CHOT) or motion (e.g., +STEP) is represented by 4 bits or a nibble. With this format, the rule can represent a melody pattern having notes up to four. SEP nibble contained in the second or motion word of rule separates one rule entry from another. The last address of the memory MPM1 stores a code END indicative of the end of the fixed melody pattern rule base. A memory MPM2 having the same format with that of MPM1 is provided in RAM 6 for the extended melody pattern rule base.

The note type succession memory NTM and the motion type succession memory MTM store a melody pattern derived from a user-input melody from the keyboard, or from an automatically composed melody. Both of NTM and MTM are provided in RAM 6. In the sinGle-word note type succession memory NTM, each note type data item is represented by a nibble (4 bits). Similarly in the one-word motion succession memory MTM, each motion data item is represented by a nibble (4 bits). Thus, the combination of NTM and MTM can represent a melody pattern having notes up to four. As will be described, in response to a newly supplied melody note (by the automatic composing or from the keyboard 8), NTM and MTM are each operated as a shift-right register which shifts the contents by a nibble. At the start of composition or at the bar-line timing, NTM and MTM are each initialized such that the leftmost nibble stores END. The illustration of NTM an MTM in FIG. 8 shows that a three-note pattern has been stored after the initialization. In the process of extending the melody pattern rule base, the contents of NTM and MTM are recorded into the extended melody pattern rule base in RAM 6, as an additional rule. In the automatic melody composing process, the contents of NTM and MTM are used to search the melody pattern rule base to see whether it contains a matching rule entry.

FIG. 9 illustrates the tempo/beat memory TBTM and the random number memory RANM. Both of TBTM and RANM reside in ROM 4. The tempo/beat memory TBTM is looked up by a designated tempo by the input device 10 to return a beat style (e.g., 16-beat style). The beat style output from the tempo/beat memory TBTM is used to condition a rhythm pattern (melody rhythm) to be generated, as described with respect to FIG. 1A. The random number memory RANM stores random number data. The memory RANM is used in the automatic composing mode to generate a pitch candidate for a new melody note. The last address of the random number memory RANM stores an end code FFFFH indicative of the terminal of the random number data.

FIG. 10 illustrates the chord progression database memory CPM. The memory CPM resides in ROM 4. The memory CPM realizes a database of chord progressions. Each chord progression entry in CPM database is made up of the following items. The first word indicates a rhythm attribute. For example, the rhythm attribute data "00111" indicates that the chord progression has a rhythm attribute appropriate for rhythm style rock (ROCK), disco (DISC) or 16-beat style (16 BE). The data item of rhythm attribute in a chord progression entry is used to test the chord progression for the designated rhythm style, as described with respect to FIG. 1A. The second word of a chord progression entry stores a CP length at higher bits and a structure attribute at lower bits. For example, if the structure attribute data item is "101", this means that the chord progression has an attribute suitable for an high-level musical structure AA or CC but unsuitable for BB structure. The structure attribute data item is used to test the chord progression to see whether it fits with the selected high-level musical structure, as described with respect to FIG. 1A. The third and following words of a chord progression entry stores a body of chord progression data. Each word represents a chord in which a chord root is stored at the highest nibble, a chord type is stored at the two middle nibbles and a chord length is stored at the lowest nibble. The last word of each chord progression entry stores a separator 0000H for separating one chord progression entry from another. The last address of the chord progression database memory CPM stores an end mark FFFFH indicative of the end of the chord progression database.

FIG. 11 illustrates the music structure database memory. This database resides in ROM 4 in FIG. 2. The music structure database memory comprises a high-level structure database memory STR1 and a low-level structure database memory STR2. The high-level structure database memory STR1 stores a database of high-level structure successions in terms of phrase structure successions for representing a structure of a music piece. Each structure word stores a high-level structure succession having phrases up to four. For example, a structure word having the first nibble of AA, second nibble of BB, third nibble of AA and the fourth nibble of END represents a music structure in which the first phrase is AA, the second phrase is BB and the third phrase is the last phrase symbolized by AA. The last address of the high-level structure database memory STR1 stores an end mark FFFFH indicative of the end of the database.

The low-level structure database memory STR2 stores a database of phrase internal structures (eiGht-measure structures). Each low-level structure entry or record in the database STR2 comprises three words in which the first word represents an attribute, and the second and third words represent an eight-measure structure. The first or attribute word contains information on high-level structures appropriate for the low-level ( eight-measure ) structure of the record. For example, the attribute word of 1100 indicates that the low-level (phrase-internal) structure in question fits with CC or DD phrase, but does not fit with AA or BB phrase. The attribute data in the low-level structure database memory STR1 is used to select a low-level structure appropriate for the selected high-level structure, as described with respect to FIG. 1A. Each four-bit nibble in the second and third words of the low-level structure entry represents a measure structure. Specifically, the first nibble (highest four bits) of the second word represents the first measure structure, the second nibble of the second word indicates the second measure structure and so on until the fourth nibble (lowest four bits) of the third word indicates the eighth measure structure. The last address of the low-level structure database memory STR2 stores an end mark word FFFFH indicative of the end of the database.

FIG. 12 illustrates the rhythm pattern database memory RPM. The memory RPM resides in ROM 4 of FIG. 2. The rhythm pattern database memory RPM stores a database of rhythm patterns (note durational successions) for automatic Generating of a melody rhythm. Each entry in the rhythm pattern database memory RPM contains four words in which the first word represents a rhythm style attribute, the second word represents a beat style attribute (by the higher bits) and a low-level structure attribute (by the lower bits), the third word indicates a note-on pattern, and the fourth word indicates a note-off pattern. For example, the first or style word of 00111 indicates that the rhythm pattern is suitable for a rhythm style of rock (ROCK), disco (DISC) or sixteen-beat (16 BE), but not suitable for swing (SWIN) or waltz (WALT) style. If the structure attribute item stored in the lower digit of the second word is 101, this indicates that the rhythm pattern of the entry is appropriate for a measure structure of aa or cc but not appropriate for a measure structure bb. The third or note-on pattern word describes respect ive note-on timinGs in a measure, while the fourth or note-off pattern word describes respective note-off timings in the measure. The last address of the rhythm pattern database memory RPM stores an end mark FFFFH of the database. The attribute data stored in the first and second words of a rhythm pattern entry is used to retrieve, from the rhythm pattern database RPM, a rhythm pattern fitting with the selected low-level structure, rhythm style and beat style (or tempo), as described with respect to FIG. 1A.

FIGS. 13 and 14 illustrate other constants and variables used in the embodiment. MPM2 indicates the extended melody pattern rule base memory or its start address. The extended melody pattern rule base MPM2 is created in RAM 6. MPM2 SIZE indicates the memory size of the extended melody pattern rule base. MEAS is the length of a measure. CP_C indicates a chord length counter or accumulator for accumulating chord lengths of a selected chord progression. T is a rhythm counter and indicates a current time. BAR is a measure counter. The value of BAR is determined by the integer part of T/MEAS. TMP indicates a designated tempo. BEAT indicates a designated beat style and is obtained by looking up the tempo/beat memory at the designated tempo TMP. STRD1 indicates a high-level structure (e.g., symbolic phrase structure AA) selected from the high-level structure database memory STR1. STRD2 represents a low-level structure (e.g., measure structure aa) selected from the low-level structure database memory STR2. PIT indicates a current pitch. PREV_PIT indicates an old pitch immediately preceeding the current pitch.

STR1_P is a high-level structure pointer pointing to a word in the high-level structure database STR1. STR2_P is a low-level structure pointer pointing to a word or address in the low-level structure database STR2. STR1D_P is a phrase counter for phrases in a high-level structure word in the high-level structure database. STR2D_P is a measure counter for an eight-measure structure contained in second and third words of an entry in the low-level structure database. The counter STR1D_P is used to retrieve a phrase structure at a currrent time from the music structure word selected from the high-level structure database. The counter STR2D_P is used to retrieve a measure structure at a current time from the low-level (eight-measure) structure entry selected from the low-level structure database. RPM_P is a rhythm pattern pointer pointing to a word or address in the rhythm pattern database memory RPM. CPH_P is a chord pointer pointing to a word or address in the chord progression database CPM. RANM_P is a random number pointer pointing to a word or address in the random number data memory RANM.

MODE indicates an operation mode of the automatic composer. A normal mode without automatic melody composing is called NORMAL. A mode in which a melody is automatically composed is called RMELODY. KEYON is a key state flag. The flag KEYON indicates a key-on state by YES and indicates a key-off state by NO. USER-MEL is a flag to indicate whether a user-input melody is present (played) in a current measure. In the automatic composing mode RMELODY, the flag USER_MEL is used to establish a rulebase-extending mode in which a melody played by a user is analyzed into a melody pattern to record it into the melody pattern rule base, as an addit tonal rule.

Overall Operation of the Embodiment

The automatic composer of the embodiment simultaneously composes and performs a melody in real time.

In response to a start-compose command from the input device, the automat ic composer enters the automatic composing mode from the normal mode. As a response, the automat ic composer determines a structure of a music piece to be composed. This is done by retrieving a music structure word from the music structure database. Further, the automatic composer locates the first phrase structure in the music structure word since it is a phrase structure with which the music begins: Then the automatic composer retrieves, from the low-level structure database, a phrase-internal structure word fitting with the first phrase structure and locates the first measure structure in the phrase-internal structure word. Further, the automatic composer retrieves, from the chord progression database, a chord progression suitable for the first phrase structure and locates the first chord in the retrieved chord progression. The automatic composer retrieves, from the rhythm pattern database a rhythm pattern which is suitable for the rhythm and beat style designated from the input device and also suitable for the first measure structure. The retrieved rhythm pattern has a length of one measure, and indicates note-on and off timings of automatic melody notes in the measure (here, the first measure) by its note-on and off pattern words.

As music time goes on according to the designated tempo, the rhythm pattern is scanned to locate a pattern element at respective timings. When the (current) pattern element indicates a note-on timing or event, the automatic composer determines a melody note pitch.

A melody note pitch is determined as follows. The automatic composer retrieves a random number from the random number data memory, and adds it to an old note pitch to thereby form a pitch candidate for a new melody note. Then, the automatic composer analyzes a melody as far as the new melody note pitch candicate into a test melody pattern represented by a note type succession NTM and a motion succession MTM. The composer searches through the melody pattern rule base MPM1, MPM2 for the test melody pattern. If the search fails, the automatic composer generates another pitch candidate and repeats the operation. If the search has succeeded, the pitch candidate involved in the successful search specifies the pitch of the new melody note. The new melody note pitch data generated in this manner is reproduced by the tone generator, thus realizing real-time melody performance.

When a note-off event is indicated by an element of the rhythm pattern at a current time, the automatic composer causes the tone generator to note-off a melody tone being sounded.

The rhythm pattern from the rhythm pattern database has a length of one measure. Thus, each time when a one-measure time has elapsed, the automatic composer selects and retrieves, from the rhythm pattern database, a new rhythm pattern (for the new measure) appropriate for the designated rhythm and beat style, and the new measure structure.

The automatic composer scans the chord progression selected from the chord progression database as time goes by. In the embodiment, each chord progression has the same length as that of a phrase (high-level structure).

When the selected chord progression or phrase has ended, the automatic composer locates a next phrase structure in the music structure word and selects an appropriate chord progression from the chord progression database.

In this manner, the automatic composer performs the automatic melody composing process. Automatic accompaniment can readily be made using the chord progression selected from the chord progression database.

In the automatic melody composing mode, the automatic composer of the embodiment also responds to a melody entered by a user from the musical keyboard. As the response, the automatic composer recognizes a pattern of the input melody and records it into the melody pattern database, as an additional rule. This is called the rule base extending feature.

Specifically, when a first key-on event occurs on the keyboard within a measure, the automatic composer enters the rule base extending mode (indicated by USER_MEL=YES). The automatic composer analyzes the user-melody notes from the keyboard with respect to note type and motion. The derived note types and motions are respectively loaded into the note type succession memory NTM and the motion succession memory MTM in a shift-right fashion. At the next bar-line time, NTM and MTM contain melody pattern information which describes a pattern or rule derived from the user-melody entered during the measure. Then, the automatic composer writes the melody pattern information in NTM an MTM into the extended melody pattern rule base memory MPM2, thus extending the stored melody pattern rule base.

When a bar-line time has come, the composer is automatically released from the rule base extending mode and returns to the automatic melody composing mode.

Flow Charts

In the following, the automatic composer of the embodiment will be described in Greater detail with reference to FIGS. 15–36.

Figure 15:
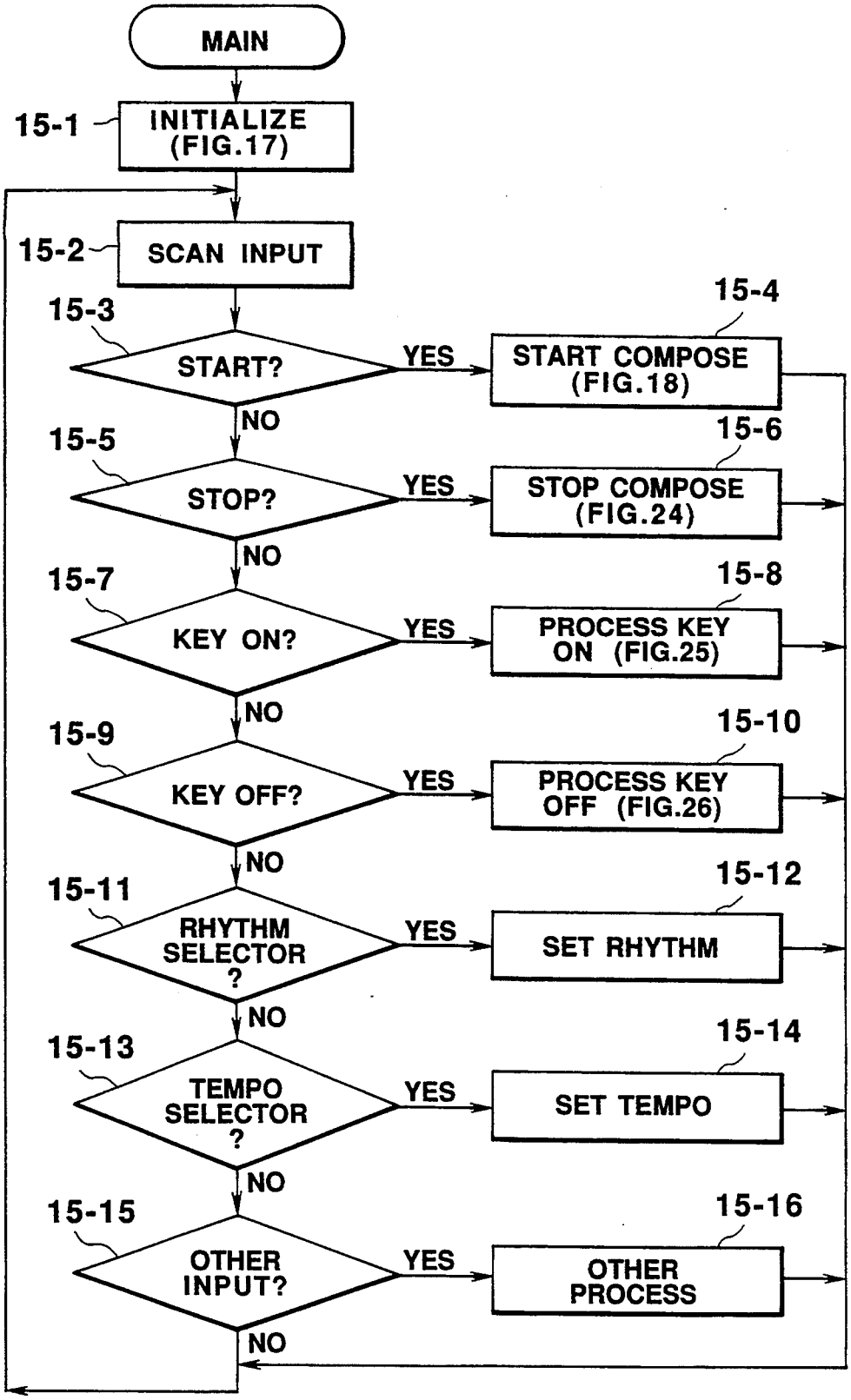
FIG. 15 is a flow chart of a main routine to be executed by CPU in FIG. 2.

Main Routine (FIG. 15)

Figure 18:
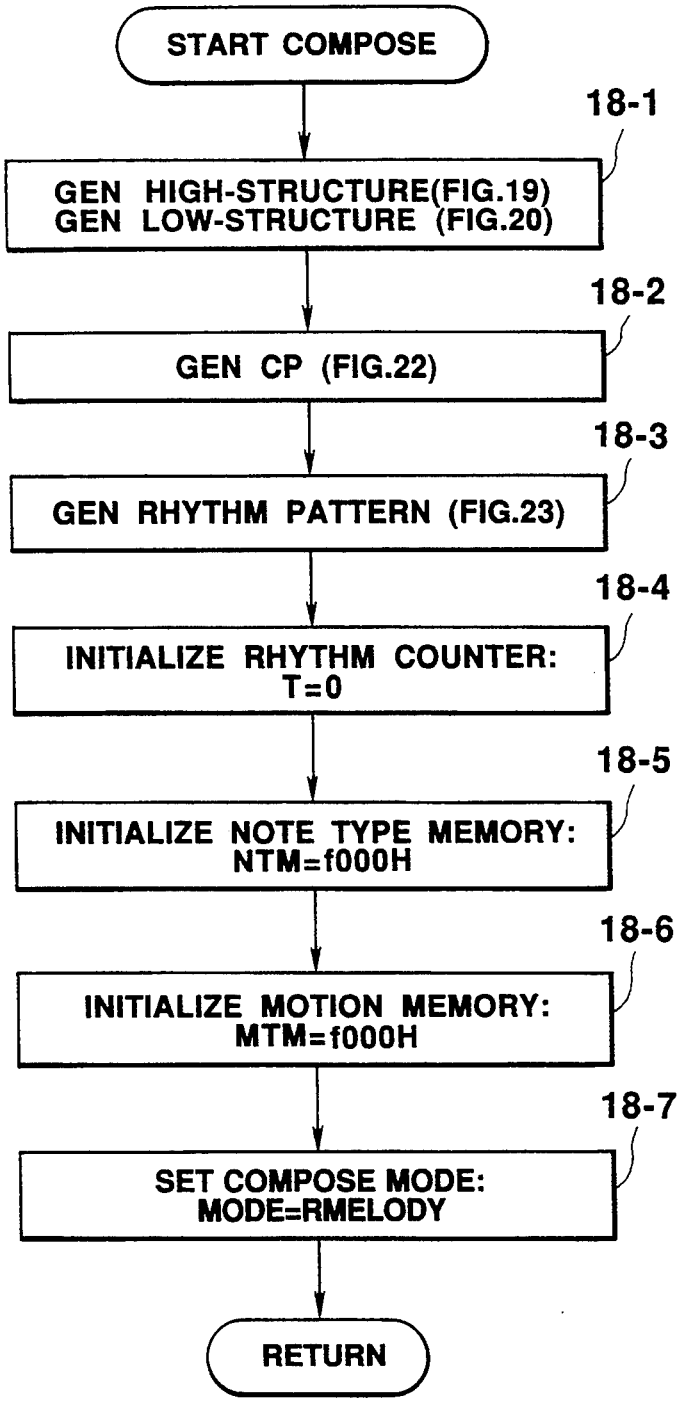
FIG. 18 is a flow chart of START COMPOSE.

FIG. 15 is a flow chart of a main routine or program to be executed by CPU 2 in FIG. 2. First (15-1), the main routine initializes the system. At the entry 15-2 in the main loop of 15-2 to 15-16, the keyboard 8 and the input device 10 are scanned to detect an operated key or switch. Then, the main loop performs a process corresponding to the operated key. Specifically, when a start-compose command key is operated (15-3), a START COMPOSE routine 15-4 (details of which are shown in FIG. 18) is executed. When a stop-compose key is operated (15-4), a STOP-COMPOSE routine 15-6 (FIG. 24) is executed. In response to a key-on event on the musical keyboard 8 (15-7), a PROCESS KEY 0N routine 15-8 (FIG. 25) is executed. In response to a key-off event on the keyboard (15-9), a PROCESS KEY OFF routine 15-10 (FIG. 26) is executed. When a rhythm change is directed by the rhythm selector in the input device 10 (15-11), a SET RHYTHM routine 15-12 is executed to set the rhythm register RHY to the appropriate rhythm style. When a new tempo is commanded by the tempo selector in the input device (15-13), a SET TEMPO routine 15-14 is executed to set the tempo register to the appropriate tempo. For other inputs (15-15), other processes are executed (15-16).

Figure 16:
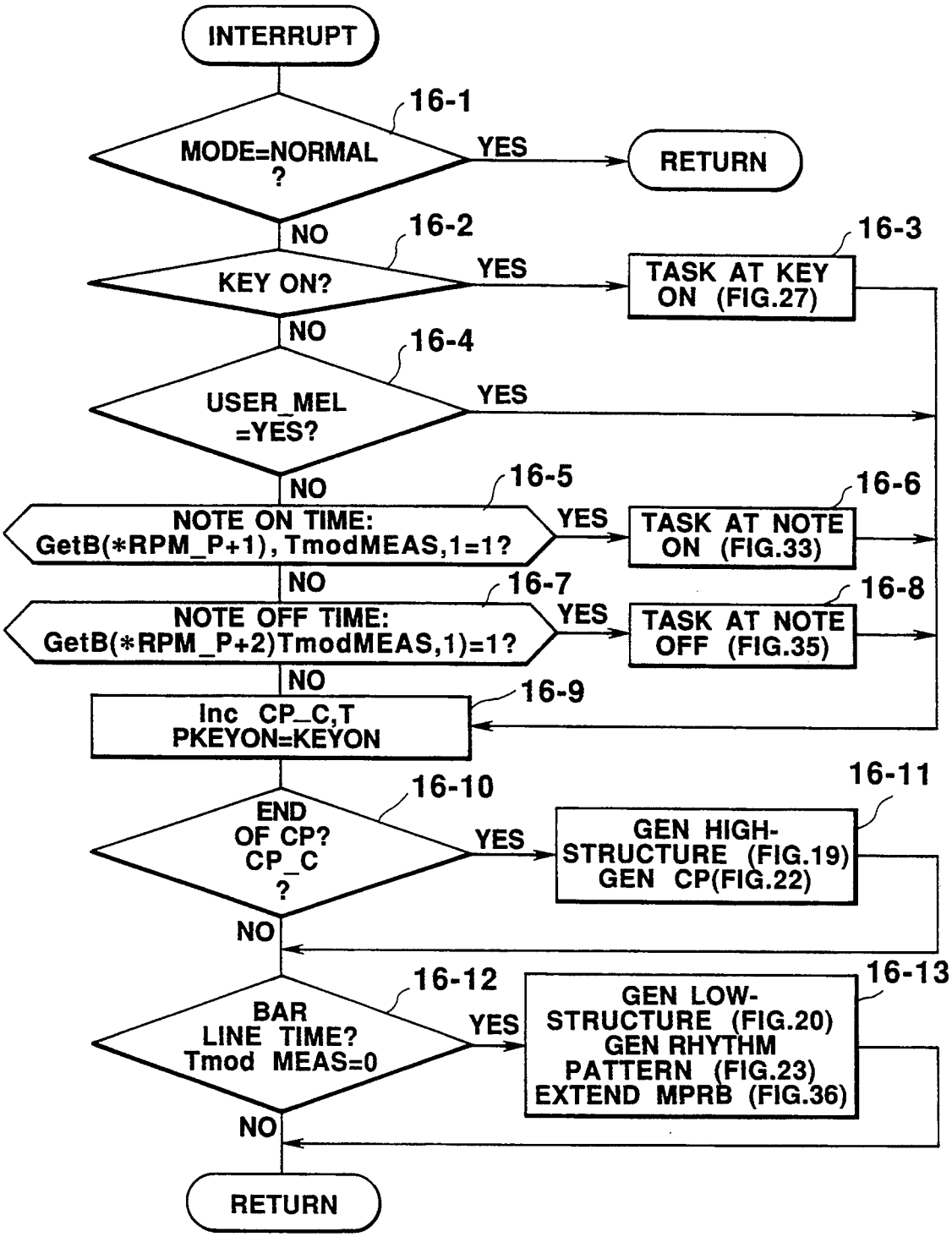
FIG. 16 is a flow chart of an interrupt routine to be executed by CPU in FIG. 2.

Interrupt Routine (FIG. 16)

FIG. 16 is a flow chart of an interrupt routine. This routine is called each time when the clock generator 18 outputs a signal indicative of elapse of the music resolution time unit.

First (16-1), the routine tests the mode flag MODE to see whether the mode is normal (MODE=NORMAL)). If the composer operates in the normal mode, the routine returns directly. If the composr operates in the automatic melody composing mode (MODE=RMELODY), the interrupt routine performs the following process.

If a key on event occurs on the keyboard (16-2), the interrupt routine executes TASK AT KEYON (FIG. 27) and moves to step 16-9. If not, the interrupt routine tests the flag USER-MEL to see whether a user-melody is played or input in a current measure, indicating the rule base extending mode (USER_MEL=YES). If this is the case, the interrupt routine skips to step 16-9. If not, the interrupt routine checks the note-on pattern at step 16-5 whether.

Get B (*RPM P+1), T mod MEAS, 1)=1 indicating an automatic melody note on timing.

If it is the note-on time of an automatic melody note, the interrupt routine executes TASK AT NOTE ON (FIG. 33) before going to step 16-9. If not the note-on time, the interrupt routine checks the note-off pattern to determine whether Get B (*RPM P+2), T mod MEAS, 1)=1 i.e., whether it is the note-off time of an automatic melody note.

If this is the case, the interrupt routine executes TASK AT NOTE OFF 16-8 (FIG. 35) before going to step 16-9. If not the note-off time, the interrupt rout ine direct 1y moves to step 16-9.

At step 16-9, the rhythm counter CP_C is incremented to update the current time, and old key state registor PKEYON is set to the current key state KEYON.

Then, the interrupt rout ine check whether the end of the chord progression has been reached. If so, the interrupt routine calls GEN HIGH-STRUCTURE (FIG. 19) and GEN CP (FIG. 22) to thereby locate a new phrase structure and generate a new chord progression for the new phrase.

If a bar-line time has come, this is detected by

T mod MEAS=0 at step 16-12. Then the interrupt routine calls GEN LOW-STRUCTURE (FIG. 20), GEN RHYTHM PATTERN (FIG. 23) and EXTEND MPRB (FIG. 36) to thereby locate a new measure structure, Generate a rhythm pattern of the new measure and extend the melody pattern rule base.

INITIALIZE (FIG. 17)

Figure 17:
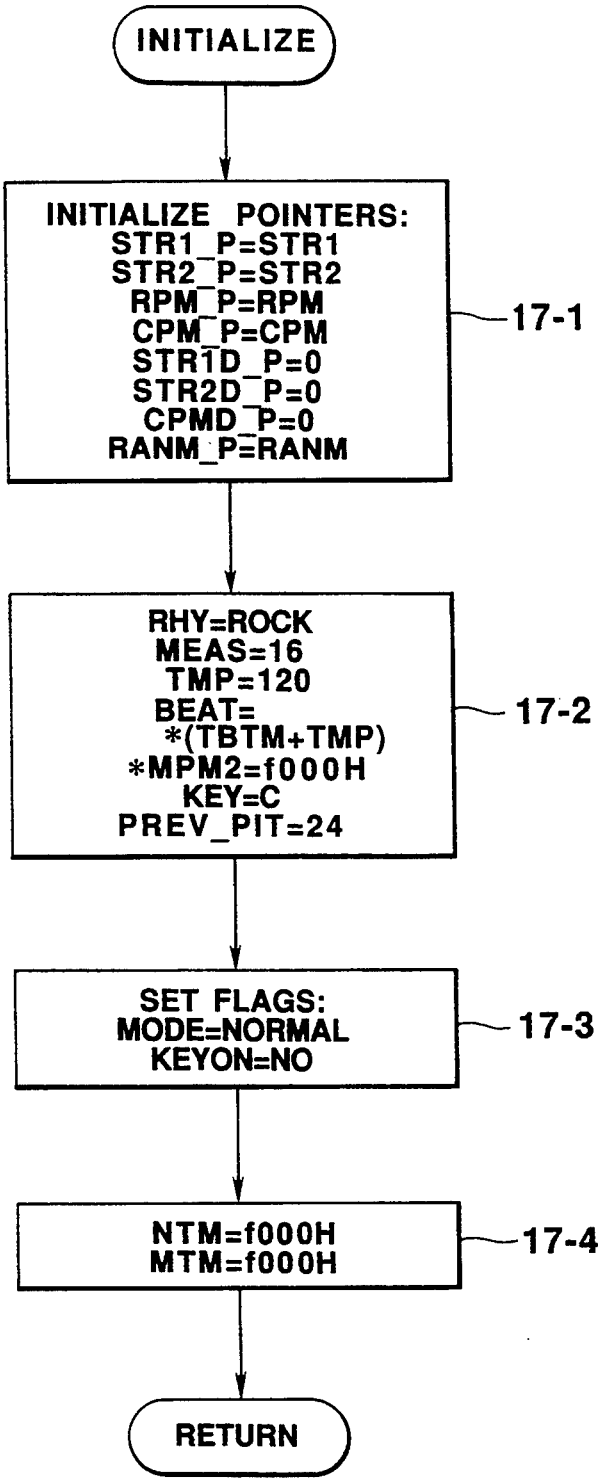
FIG. 17 is a detailed flow chart of INITIALIZE.

FIG. 17 shows details of the INITIALIZE 15-11 in the main routine. Step 17-1 initializes pointers by STR1_P=STR1,
STR2_P=STR2,
RPM_P=RPM,
CPM_P=CPM,
STR1D_P=0,
STR2D_P=0,
CPMD_P=0, and
RANM_P=RANM.

Step 17-2 initializes other variables by

RHY=ROCK,
MEAS=16
TMP=120
BEAT=*(TBTM+TMP)
*MPM 2=fOOOH,
KEY=C, and
PREV_PIT=24.

Step 17-3 set flags by

MODE=NORMAL and
KEYON=NO.

The last step 17-4 initializes the note type and motion memories by

NTM=fOOOH and
MTM=fOOOH.

START COMPOSE (FIG. 18)

FIG. 18 shows details of the START COMPOSE routine 15-4. This routine is called when a start-compose command is provided from the input device.

First (18-1), GEN HIGH-STRUCTURE (FIG. 19) and GEN LOW-STRUCTURE (FIG. 20) is called to select the musical structure of a music piece to be composed. Then (18-2), GEN CP (FIG. 22) is executed to select, from the chord progression database, a chord progression for the high-level (phrase) structure. At 18-3, GEN RHYTHM PATTERN (FIG. 23) is called to retrieve, from the rhythm pattern database, a rhythm pattern appropriate for the low-level or measure structure, and designated rhythm and beat style. At 18-4, the rhythm counter is initialized by T=0. At 18-5, the note type memory is initialized by NTM=fOOOH. At 18-6, the motion memory is initialized by MTM=fOOOH. At 18-7, the automatic melody composing mode is established by MODE=RMELODY.

GEN HIGH-STRUCTURE (FIG. 19)

Figure 19:
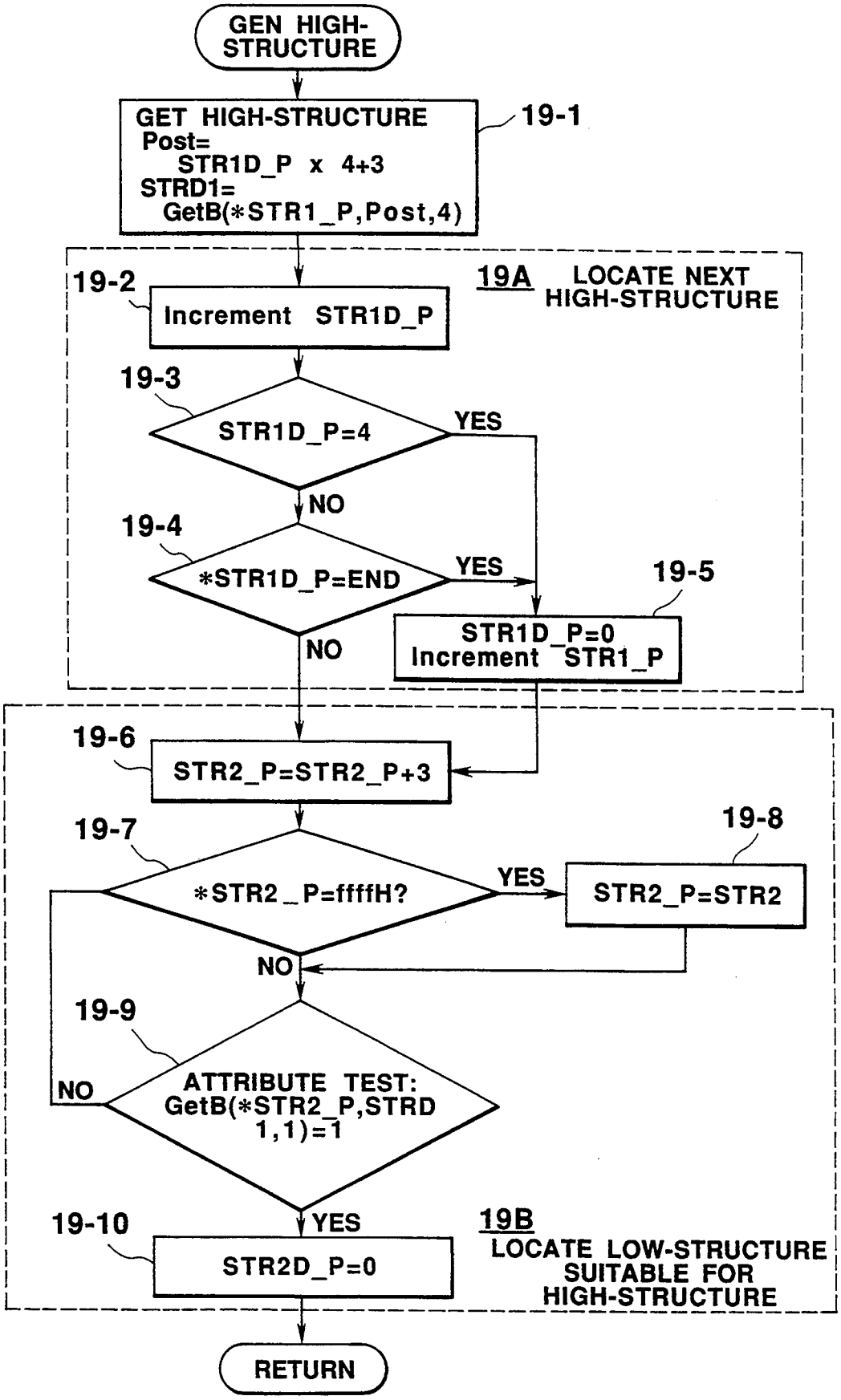
FIG. 19 is a flow chart of GEN HIGH-STRUCTURE (generate a musical structure at a high level), together with a diagram illustrating the operation.

FIG. 19 details the GEN HIGH-STRUCTURE routine. This routine is called when the automatic composer receives a start-compose command from the input device, or when the end of a selected chord progression has been reached. The object of this routine is to generate a high-level structure of a music piece and to locate a low-level structure appropriate for the generated high-level structure. A high-level structure is Generated by retrieving high-level structure data from the high-level structure database STR1.

Specifically, step 19-1 executes:

post=STR1D_PX4+3, and
STRDI=Get B (*STR1_P, post, 4)

In doing so, it retrieves, from the high-level structure database STR1, high-level or phrase structure data STRD 1 indicative of a symbolic phrase structure.

In block 19A including steps 19-2 to 19-5, GEN HIGH-STRUCTURE routine locates the next high-level structure in preparation for the next passing of the routine. Specifically, STR1D_P is incremented (19-2). If STR1D_P=4(19-3) or if *STR1D_P=END (19-4), STR1D_P is initialized to 0 and STR1_P is incremented (19-5).

In block 19B including steps 19-6 to 19-10, GEN HIGH-STRUCTURE routine locates a low-level (eight-measure) structure suitable for the high-level structure retrieved in the block 19-1. As will be described, elements (individual) measure structures) of the located low structure will be retrieved at appropriate times (see FIG. 20).

Specifically, step 19-6 executes

STR2_P=STR2_P+3

If *STR2_P=ffffH(19-7), step 19-8 initializes STR2_P equal to STR2 (19-8). Attribute test step 19-9 checks whether Get B (*STR2_P, STRD1, 1)=1

If this is the case (indicating that the low-level structure is appropriate for the high-level structure), step 19-10 locates the first measure in the low-level structure by STR2D_P=0.

As understood from FIG. 11, suitability of a low-level eight-measure structure entry in the low-level structure database STR2 is determined by testing or matching its attribute data against the selected high-level phrase structure data STRD1 (e.g., AA) .

GEN LOW-STRUCTURE (FIG. 20)

Figure 20:
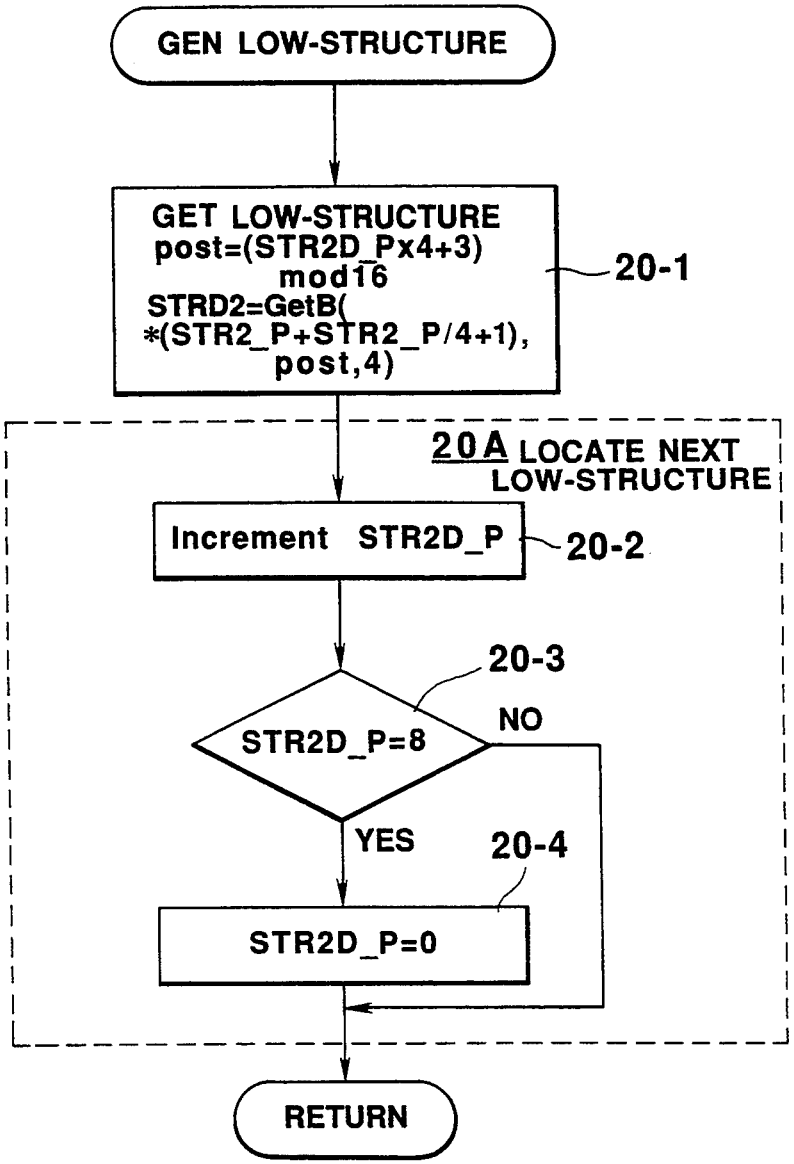
FIG. 20 is a flow chart of GEN LOW-STRUCTURE (Generate a musical structure at a low level)

FIG. 20 is a detailed flow chart of the GEN LOW-STRUCTURE routine. This routine is called in the first block 18-1 of START-COMPOSE after GEN HIGH-STRUCTURE has been executed. The routine is also called in the block 16-12 of the interrupt routine (FIG. 16) at a bar-line time. The object of this routine is to Generate a new low-level (measure) structure.

Specifically, step 20-1 Gets low-level structure data by:

post=(STR2D_P×4+3) mod 16, and

STRD2=Get B (*(STR2_P+BTR2_P/4+1), post, 4)

In the block 20A including steps 20-2 to 20-4, GEN LOW-STRUCTURE locates the next low-level structure in preparation for the next pass of the routine. At step 20-2, low-level structure element (measure) counter STR2D_P is incremented.

If STR2D_P=8 (20-3), the counter STP2D_P is re-initialized to 0 (20-4).

Figure 21:
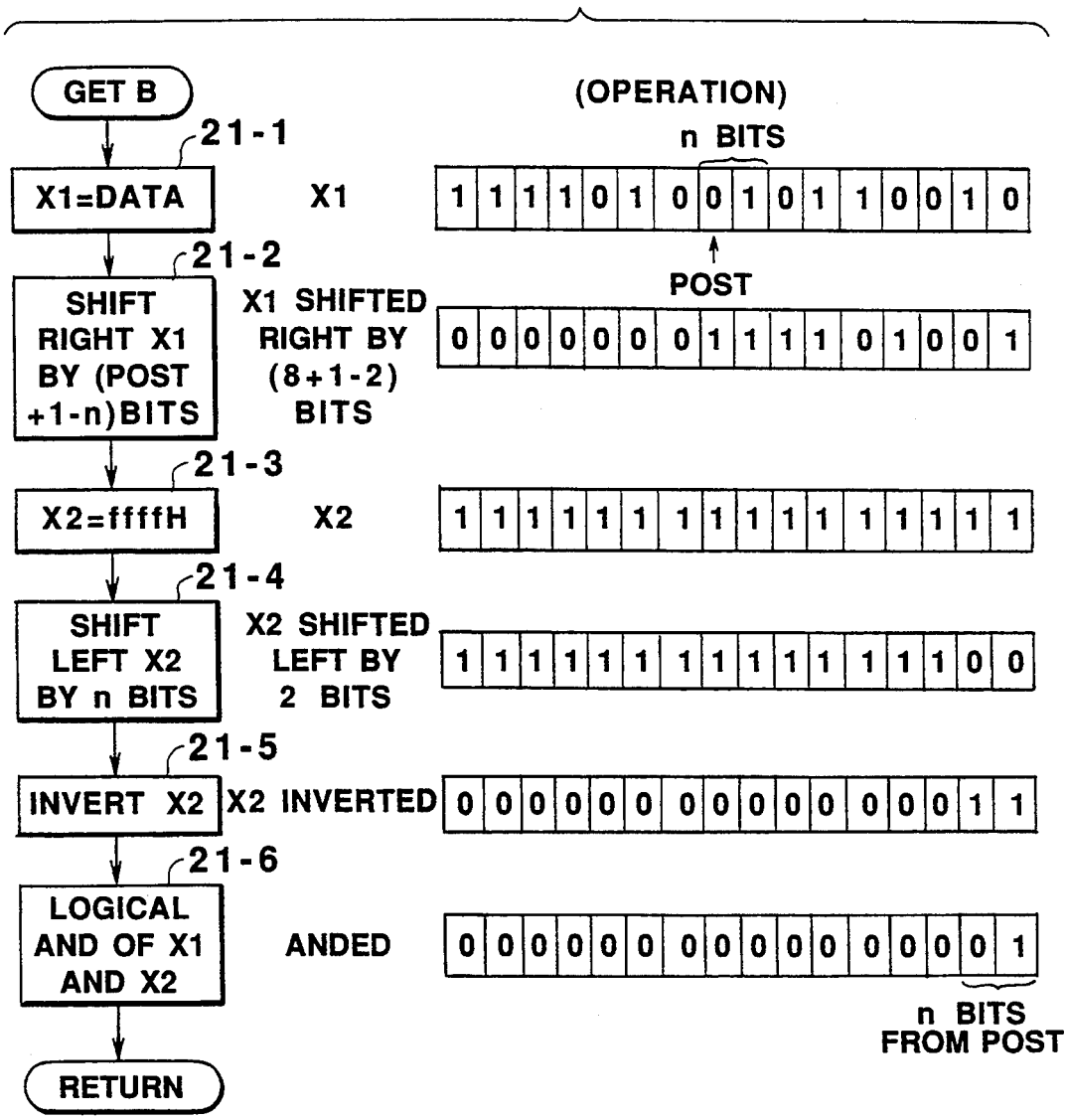
FIG. 21 is a flow chart of GET B.

Get B (FIG. 21)

FIG. 21 shows details of the function instruction Get B. The function instruction Get B (data, post, n) is a function to retrieve a desired data item in a word. Specifically, the function Get B (data, post, n) is an instruction to get n-bit data in a 16-bit memory word, beginning with the bit position post and to the right. The function instruction is called in various routines when required (e.g., in GEN HIGH-STRUCTURE ROUTINE at step 19-1).

Specifically, the function Get B (data, post,n) is an instruction to get n-bit data in a 16-bit memory word, beginning with the bit position post and to the right. The function instruction is called in various routines when required (e.g., in GEN HIGH-STRUCTURE ROUTINE at step 19-1.

Specifically, it executes X1=data (21-1). Shift right X1 by (post +1-n) bits (21-2). X2=ffffH(21-3). Shift left X2 by n bits (21-4) Invert X2 (21-5). Finally (21-6) Logically AND X1 and X2

In the operation illustrated in FIG. 21, the Get B function gets, from the 16-bit word, two bits (01) right from the eighth bit. As the result, the two bits (01) are stored in the 16-bit word at its first and LSB bit positions.

GEN CP (FIG. 22)

Figure 22:
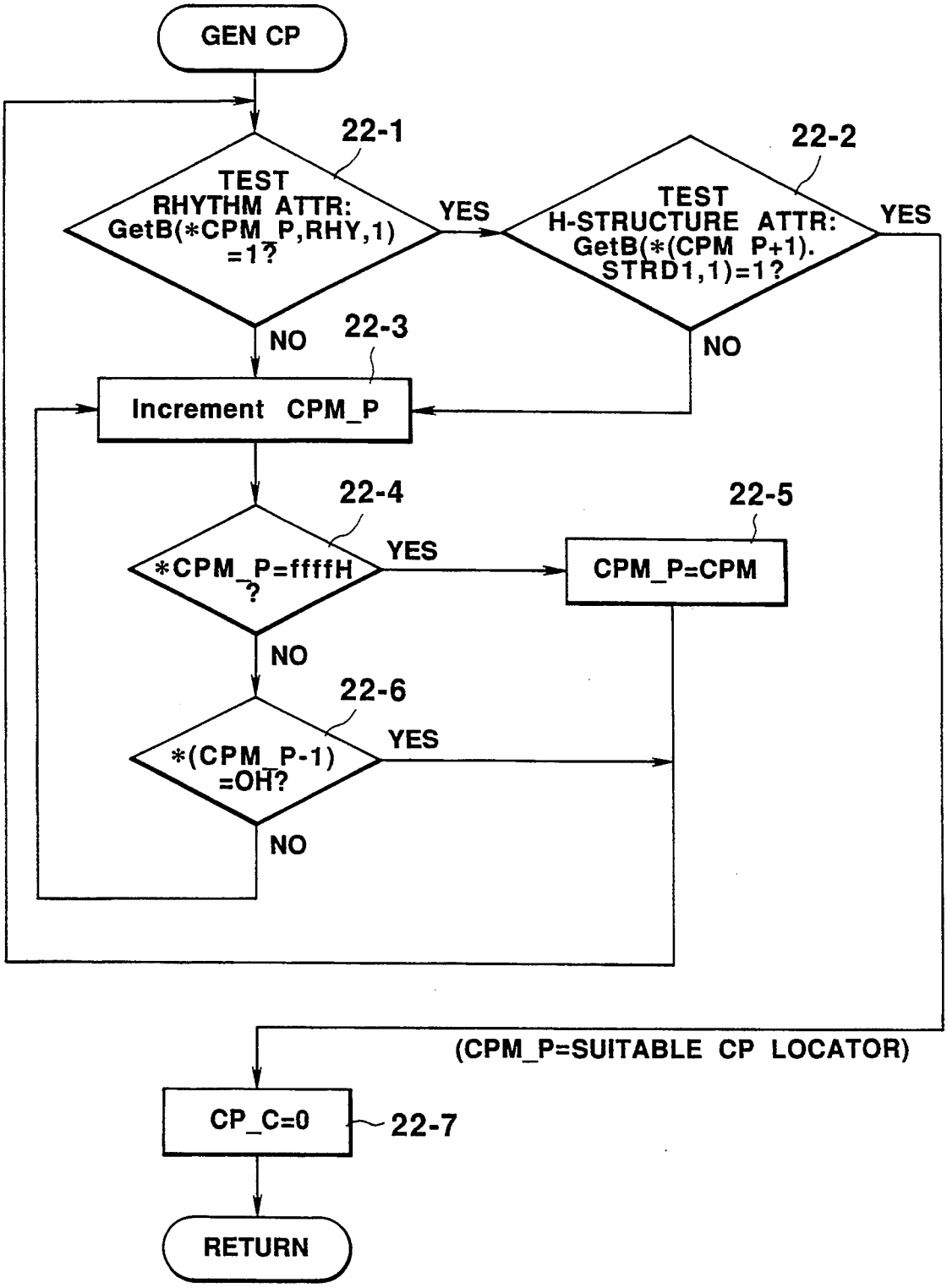
FIG. 22 is a flow chart of GEN CP (generate chord progression)

FIG. 22 shows details of GEN CP routine. This routine is called in the step 18-2 of START COMPOSE. The routine is also called in the step 16-10 each time when a chord progression ends. The GEN CP routine retrieves, from the chord progression databse, a chord progression appropriate for the designated rhythm style and also appropriate for the high-level structure.

Specifically, step 22-1 tests the rhythm attribute of an accessed chord progression to see whether it fits for the designated rhythm style by Get B(*CPM_P), RHY, 1)=1

If so, step 22-2 tests the structure attribute of the chord progression to see whether it is suitable for the selected high-level (phrase) structure by Get B (*CPM_P+1), STRD1, 1)=1. If either test fails, GEN CP routine execute steps 22-3 to 22-6 to locate the next chord progression record or entry in the chord progression database. At 22-3, the word pointer CPM_P of the chord progression database is incremented. At 22-4, it is checked whether *CPM_P=ffffH (end of chord progression database). At step 22-6, it is checked whether *(CPM_P-1)=OH (first entry of chord progression). If *(CPM_P-1)=OH is false, GEN CP routine returns to rhythm attribute test step 22-1. If *CPM_P)=ffffH is detected (22-4), the routine initializes the pointer CPM_P to the start of chord progression database CPM (22-5) before returning to step 22-1. If *(CPM_P-1)=OH is true (step 22-6), the routine returns to step 22-1.

If both tests at 22-1 and 22-2 are successful, the pointer CPM_P locates the appropriate chord progression. Then, step 22-7 is executed to set the chord pointer so as to locate the first chord in the appropriate chord progression by CP_C=0.

GEN RHYTHM PATTERN (FIG. 23)

Figure 23:
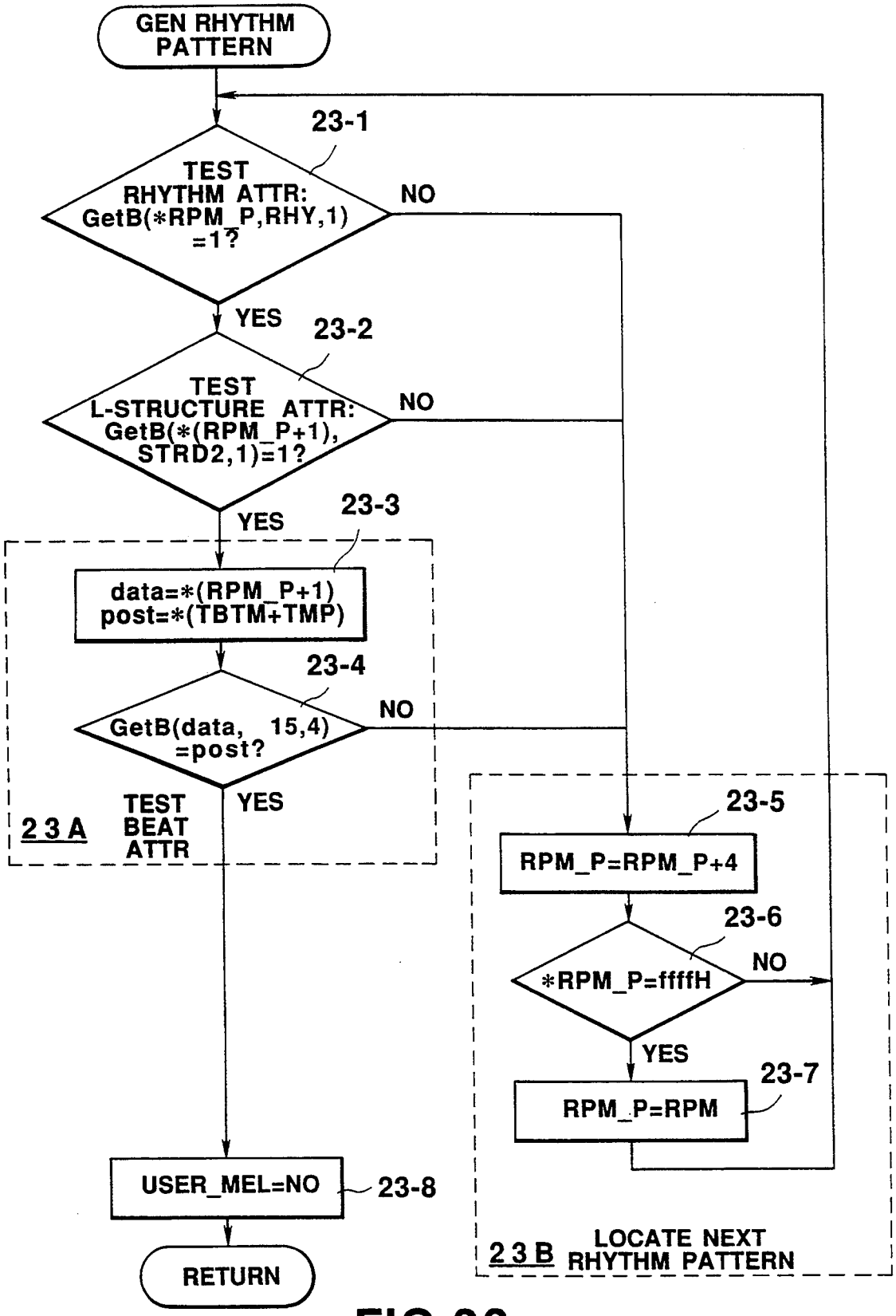
FIG. 23 is a flow chart of GEN PHYTHM PATTERN.

FIG. 23 is a detailed flow chart of the GEN RHYTHM routine. This routine is called in step 18-3 at the time of START COMPOSE or in step 16-13 at a bar-line time. The object of the routine is to retrieve, from the rhythm pattern database RPM, a one-measure rhythm pattern appropriate for the designated rhythm style, appropriate for the tempo or beat style, and appropriate for the low-level (measure) structure. The retrieved rhythm pattern determines the rhythm of a one-measure melody to be newly composed.

Specifically, step 23-1 tests the rhythm attribute of an accessed rhythm pattern to see whether it fits for the designated rhythm style RHY by:

Get B (*RPM_P, RHY, 1)=1

Step 23-2 tests the low-level structure attribute of the accessed rhythm pattern to see whether it is suitable for the new measure (low-level) structure STRD 2 by Get B (*(RPM_P+1), STRD 2, 1)=1

Block 23A including steps 23-3 and 23-4 tests the beat attribute of the rhythm pattern: Step 23-3 executes data=* (RPM_P+1), and post=* (TBTM+TMP).

Step 23-4 checks whether

Get B (data, 15, 4)=post

If either attribute test (23-1, 23-2 or 23A) fails, the block 23B including steps 23-5 to 23-7 locates the next rhythm pattern: Step 23-5 executes RPM P=RPM P+4 Step 23-6 checks whether

*RPM_P=ffffH

If this is the case (i.e., detection of the end of the rhythm pattern database), step 23-7 initializes the rhythm pattern pointer RPM_P so as to locate the start of the rhythm pattern database RPM by RPM_P=RPM.

If all attribute tests (23-1, 23-2, 23A) have succeeded, GEN PHYTHM PATTERN routine causes step 23-8 to execute USER_MEL=NO, thus releasing the automatic composer from the rule base extending mode.

STOP COMPOSE (FIG. 24)

Figure 24:
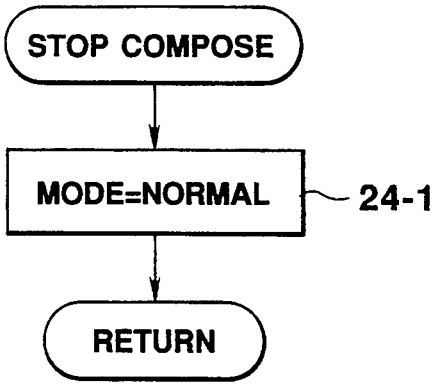
FIG. 24 is a flow chart of STOP COMPOSE.

FIG. 24 details the STOP COMPOSE 15-6 which is called upon the stop compose command 15-5. As indicated in 24-1, MODE=NORMAL is executed to return the system to a normal mode operation in which the system does not perform the automatic melody composing process.

PROCESS KEY ON (FIG. 25)

Figure 25:
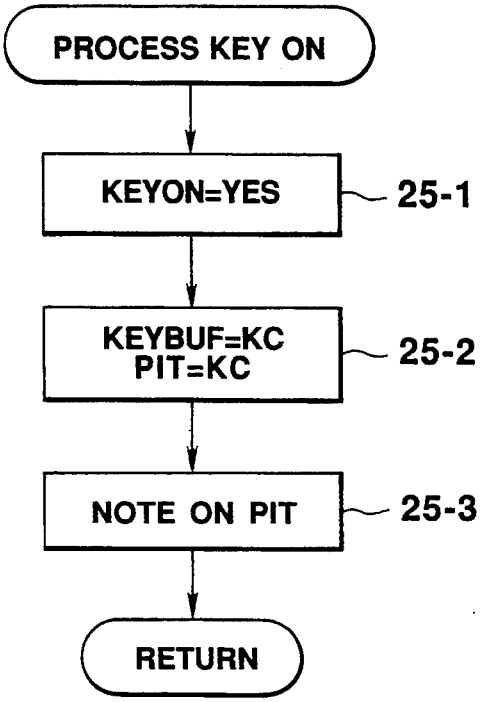

FIG. 25 details the PROCESS KEY ON routine 15-8 which is called opon the key-on event 15-7. Step 25-1 executes

KEYON=YES, indicating a played key on the keyboard. Step 25-2 sets KEYBUF equal to KC (key code of the played key), and sets pitch data register PIT equal to KC. Then, step 25-3 generates a tone of pitch PIT.

In this manner, the note-on task by the tone generator 12 for the playing of the keyboard 8 is executed in the main routine (FIG. 15) at step 15-8.

PROCESS KEY OFF (FIG. 26)

Figure 26:
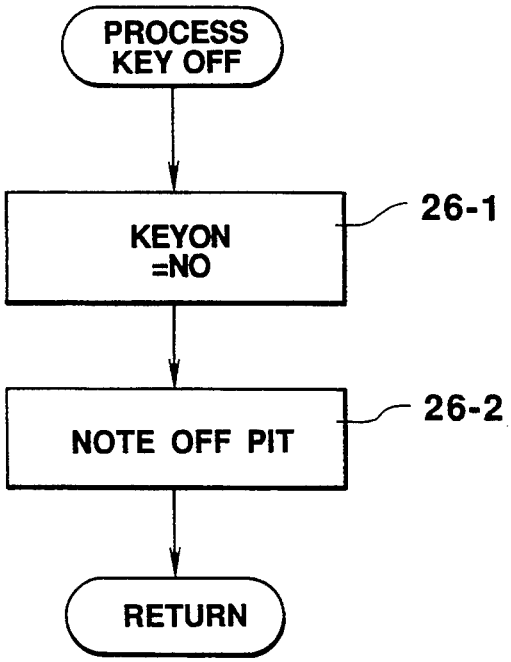
FIG. 26 is a flow chart of PROCESS KEY OFF.

FIG. 26 details the PROCESS KEY OFF routine 15-10 called upon a key-off event on the keyboard. Step 26-1 executes KEY ON=NO to indicate the key-off event. Step 26-1 notes off or releases the tone of PIT.

TASK AT KEY ON (FIG. 27)

Figure 27:
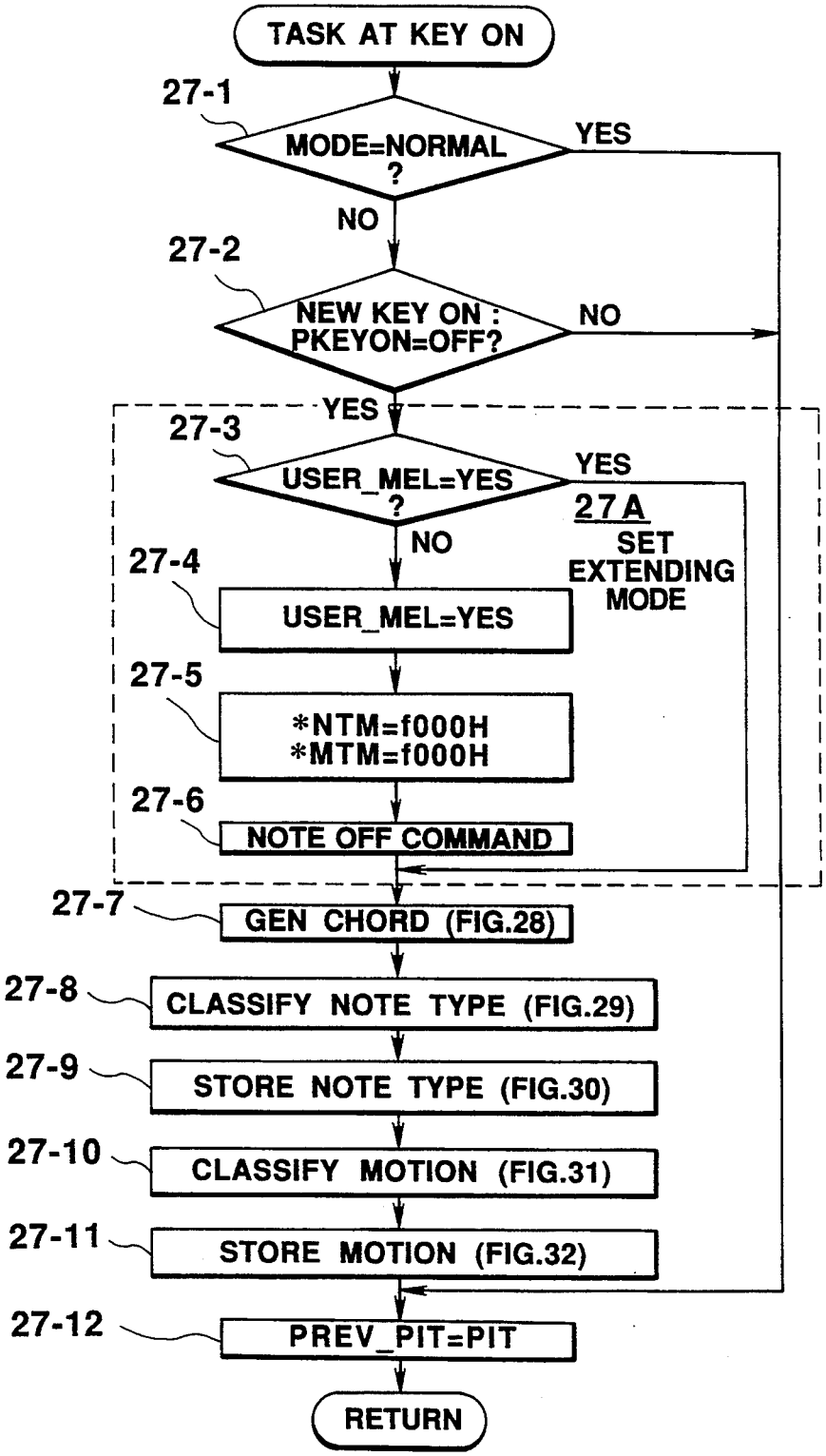

FIG. 27 shows details of the TASK AT KEY ON routine. This routine is called in the interrupt routine (FIG. 16) when it detects a played key on the keyboard (KEYON=YES at step 16-2). The TASK AT KEY ON routine establishes the rule base extending mode in response to the first key on event occurred in a measure. In the rule base extending mode, the routine recognizes a pattern of the user-input melody from the keyboard.

Figure 28:
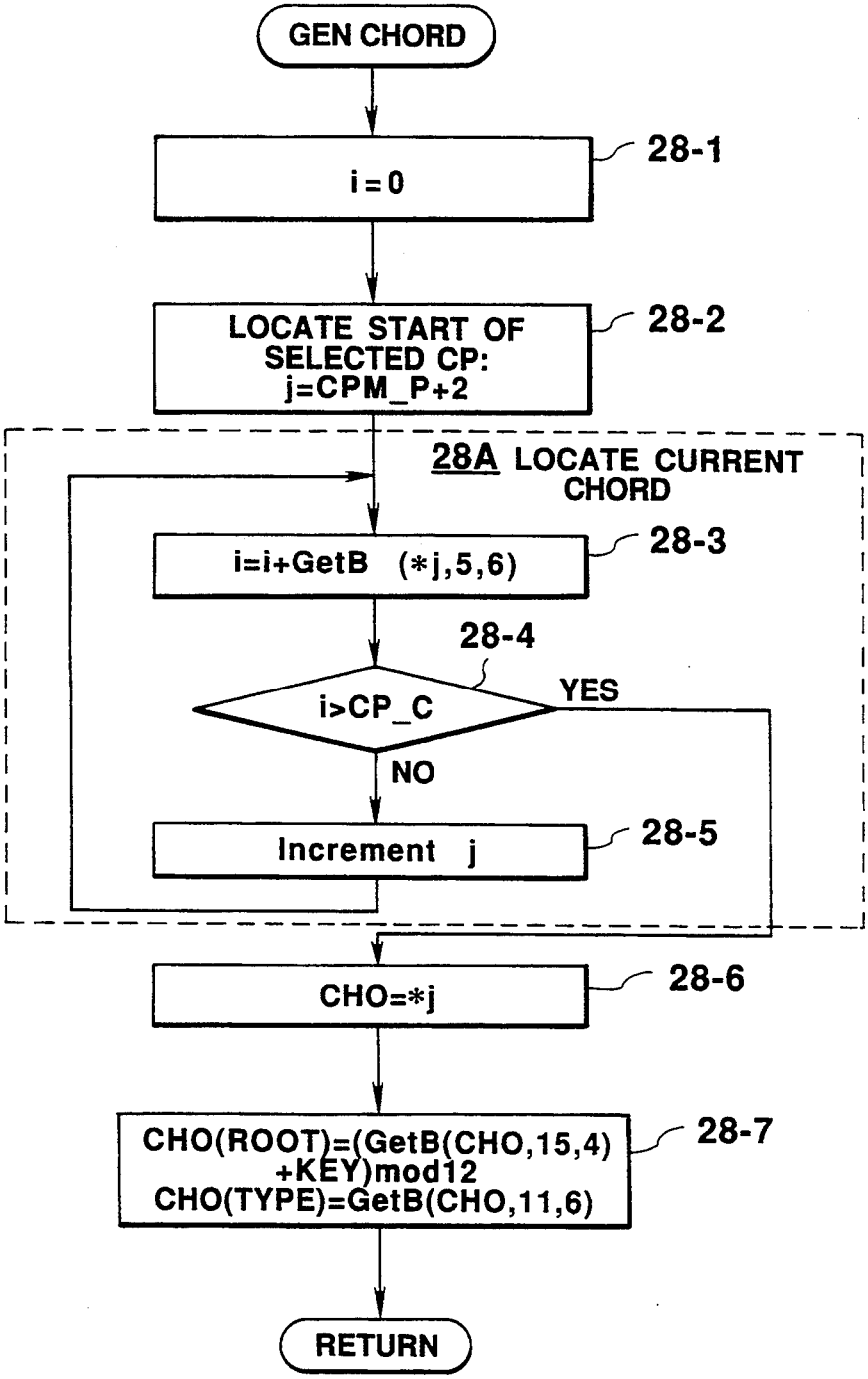
FIG. 28 is a flow chart of GEN CHORD.

Specifically, if MODE=NORMAL is true (27-1), the routine ships to the step 27-12 to move PIT to PREV-PIT. If MODE=NORMAL is false, indicating the automatic melody composing mode RMELODY, the routine moves to the step 27-2 to check whether PKEYON=OFF i.e., whether a new key on event has just occurred. If not (indicating a key is being held down), the routine skips to step 27-12. If a new key on event is detected (27-2), the routine moves to step 27-3. Step 27-3 checks whether USER-MEL=YES i.e., whether the rule base extending mode has been established. If established, the routine skips to GEN CHORD step 27-7 (FIG. 28). If not, the routine moves to step 27-4 to establish the rule base extending mode by USER-MEL=YES. The next step 27-5 initializes the note type and motion succession memories by *NTM=fOOOH and *MTM=fOOOH. Step 27-6 issues a note-off command to release an automatic melody note or notes currently sounding. Steps 27-3 to 27-6 define the process for setting the rule base extending mode, as indicated by block 27A.

Step 27-7 calls the GEN CHORD routine (FIG. 28) to get current chord information. CLASSIFY NOTE TYPE step 27-8 (FIG. 29) classifies the type of the melody note of the played key. STORE NOTE TYPE step 27-9 (FIG. 30) stores the classified type. CLASSIFY MOTION step 27-10 (FIG. 31) classifies the motion of the melody note of the played key from the old note previously played. STORE MOTION step (FIG. 32) stores the classified motion.

Finally, step 27-12 moves contents of the current pitch register to the old pitch register by PREV-PIT=-PIT.

GEN CHORD (FIG.28)

FIG. 28 is a detailed flow chart of GEN CHORD routine. This routine is called in step 27-7 of TASK AT KEY ON routine (FIG. 27) for pattern recognition of the user-input melody. The routine is also called in step 33-6 of TASK AT NOTE OFF routine (FIG. 33) for automatic melody composing. The object of GEN CHORD is to retrieve a chord at a current time from the chord progression selected from the chord progression database.

Specifically, step 28-1 initializes the chord length accumulator by i=0. Step 28-2 locates the first chord in the selected chord progression by j=CPM-P+2. Block 28A including steps 28-3 to 28-5 locates the current chord (i.e., chord prevailing at a current time): Step 28-3 executes i=i+Get B (*j, 5, 6)

Step 28-4 checks whether i>CP-C

If not, step 28-5 increments j.

If the current chord has been located, the routine goes to step 28-6 to load the current chord data into CHO register by CHO=*j. Then, step 28-7 gets the root and type information of the current chord by CHO(ROOT)=(Get B (CHO, 15, 4)+KEY) mod 12

CHO(TYPE)=Get B (CHO, 11, 6)

CLASSIFY NOTE TYPE (FIG. 29)

Figure 29:
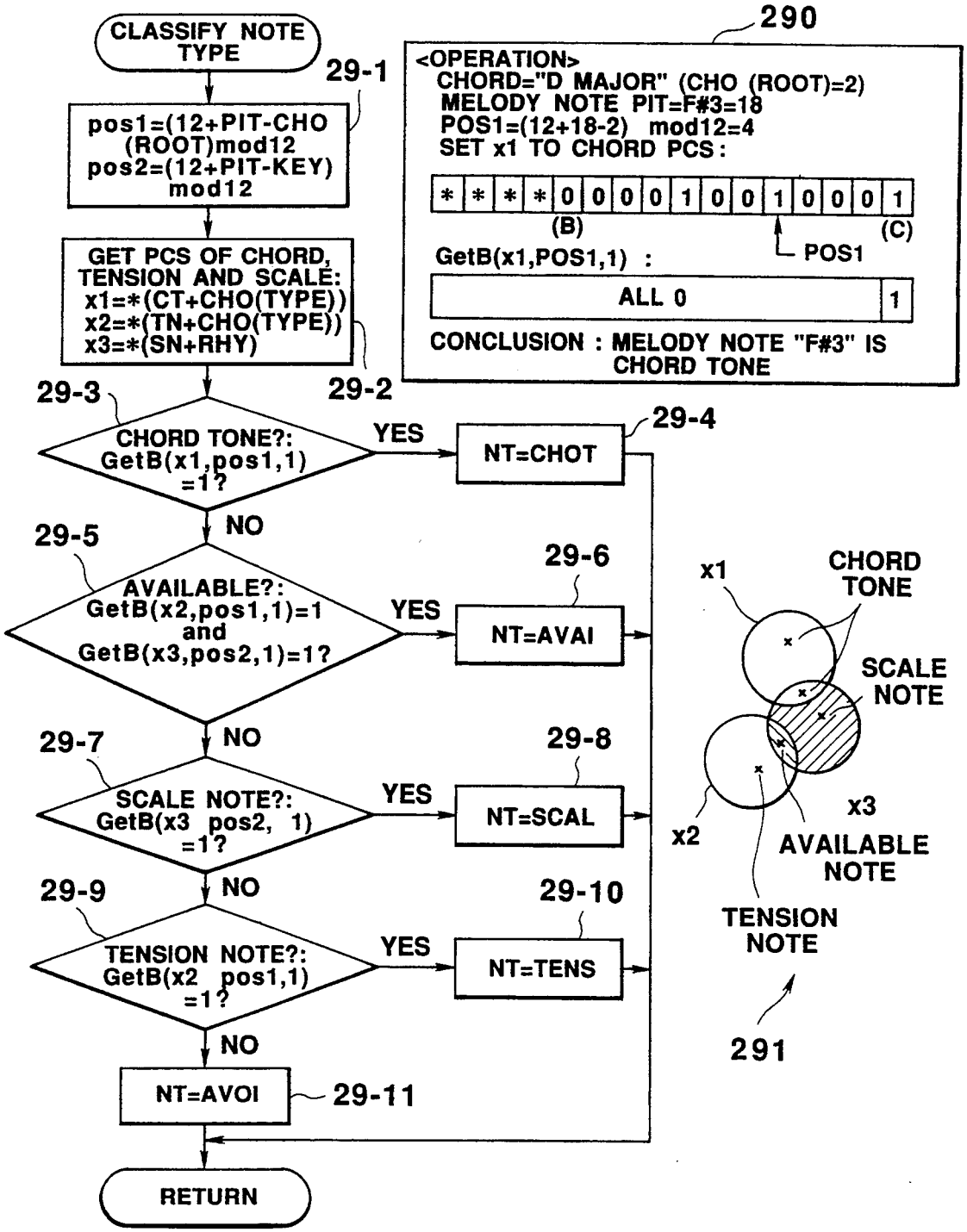
FIG. 29 is a flow chart of CLASSIFY NOTE TYPE, also showing an illustrative operation.

FIG. 29 shows details of the CLASSIFY NOTE TYPE routine. This routine is called in step 27-8 for melody pattern recognition, or in step 33-7 of TASK AT NOTE OFF (FIG. 33) for automatic melody composition. The object of the routine is to classify the type of a melody note (which is either a played note on the keyboard or a candidate for an automatic melody note). To this end, the routine utilizes the chord information from GEN CHORD routine (FIG. 28), keynote information, designated beat style information RHY, and a standard pitch class set of chord tones, scale notes and tension notes.

Specifically, step 29-1 computes posl and pos2 by:

pos1=(12+PIT-CHO(ROOT)) mod 12 pos2=(12+PIT-KEY) mod 12

Thus, pos1 indicates the interval or pitch distance of pitch PIT from chord root CHO (ROOT), and pos2 indicates the interval of pitch PIT measured from key note KEY. The next step 29-2 gets pitch class sets (PCSs) each of chord, tension and scale by

X1=*(CT+CHO(TYPE))

X2=*(TN+CHO(TYPE))

X3=*(SN+RHY)

Step 29-3 checks whether

Get B (X1, pos1, 1)=1

If this is the case, step 29-4 executes NT=CHOT, thus concluding that the melody note of interest is the note type of a chord tone. Step 29-5 checks whether Get B (X2, pos1, 1)=1, and Get B (XJ, pos2, 1)=1.

If this is true, step 29-6 executes NT=AVAI, thus announcing that the note type is an available note. Step 29-7 checks whether Get B (XJ, pos2, 1)=1

If this holds, step 29-8 executes NT=SCAL, thus announcing that the classified note type is a scale note. Step 29-9 examines the melody note to see whether it is a tension note by checking whether Get B (X2, pos1, 1)=1.

If this is true, step 29-10 declares that the note type is a tension note by NT=TENS. If all the tests 29-3, 29-5, 29-7, 29-9 are negative, step 29-11 declares that the note type is an avoid note by NT=AVOI.

The operation chart 290 illustrates how a note of F#3 (PIT=F#3) is classified into a chord tone when a current chord is D Major.

In the Venn diagram 291, circles X1, X2 and X3 represent a chord tone PCS, tension note PCS and scale note PCS, respectively. A melody note which is an element of the set X1 is classified into a chord tone. An overlapped portion common to sets X2 and X3 defines the region of available note. A portion of the set X3 which is not overlapped with X1 or X3 specifies the region of scale note. A portion of the set X2 not overlapped with X3 is the region of tension note. If a melody note falls outside of the circles X1, X2 and X3, it is classified into an avoid note.

STORE NOTE TYPE (FIG. 30)

Figure 30:
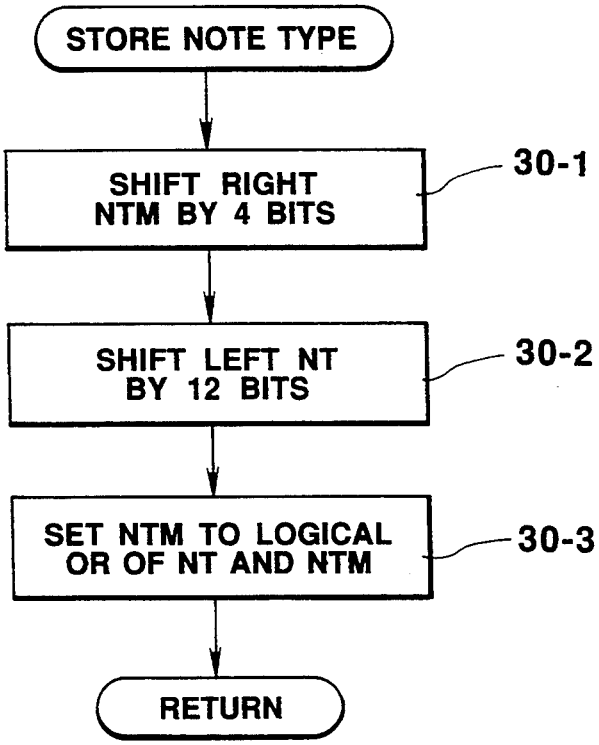
FIG. 30 is a flow chart of STORE NOTE TYPE.

FIG. 30 details the STORE NOTE routine. This routine is called in step 27-8 for user-melody pattern recognition or in step 33-8 for automatic melody analysis. The STORE NOTE TYPE routine stores the note type NT classified in the CLASSIFY NOTE TYPE routine (FIG. 29) into NTM memory by operating NTM as a shift-right register. Specifically, step 30-1 shifts right NTM by 4 bits. Step 30-2 shifts left NT by 12 bits so that the leftmost nibble contains the note type information. Step 30-3 ORes NT and NTM and loads the result into NTM.

CLASSFY MOTION (FIG. 31)

Figure 31:
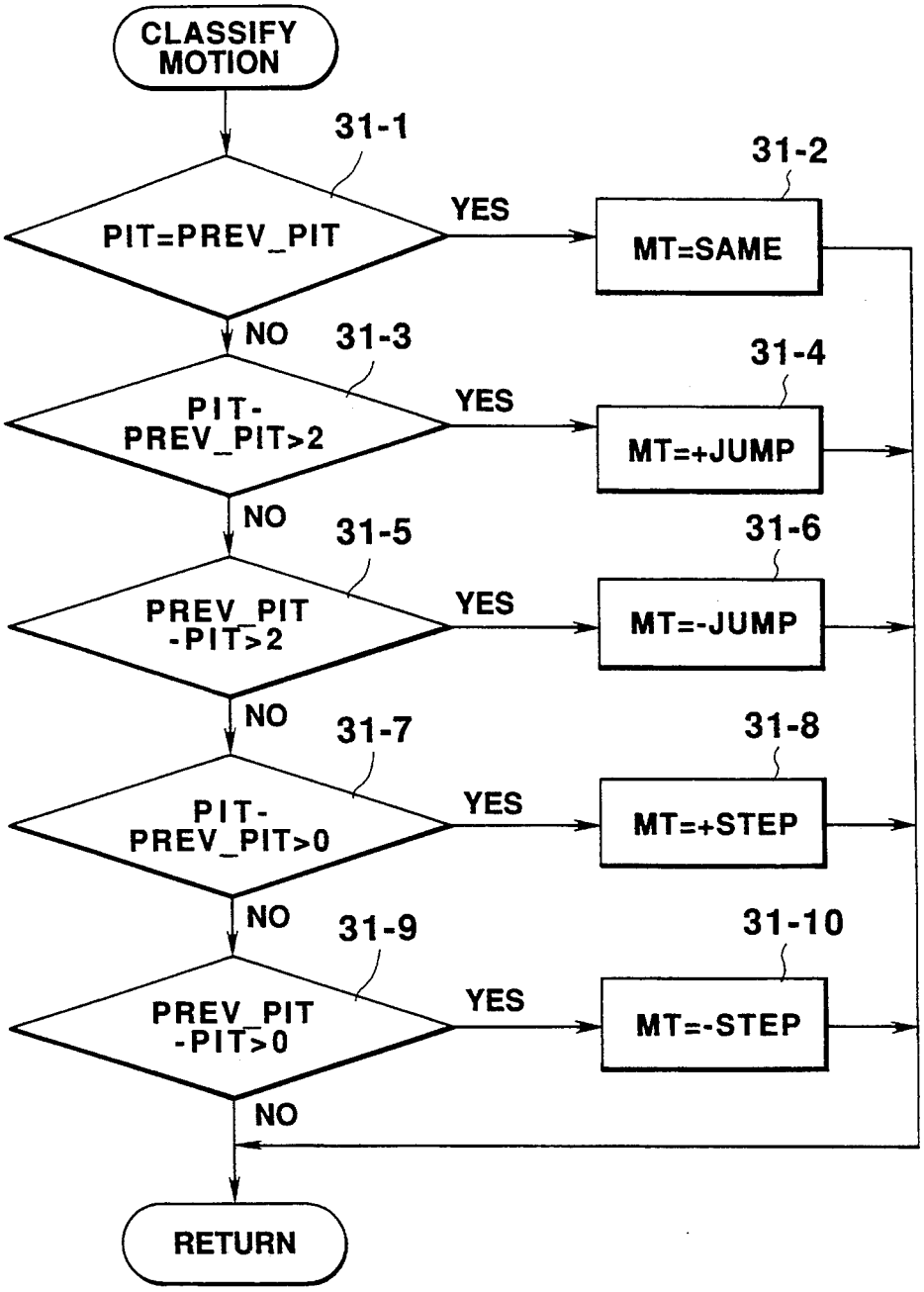
FIG. 31 is a flow chart of CLASSIFY MOTION.

FIG. 31 shows details of the CLASSIFY MOTION routine. This routine is called in step 27-1 or 33-7. The CLASSIFY MOTION routine compares the current pitch PIT with the preceding pitch PREV-PIT and classifies the motion formed therebetween.

Specifically, if PIT=PREV_PIT (31-1), the routine declares no motion by MT=SAME (31-2). If Pit-PREV_PIT>2 (31-3), it declares an ascending leap or jump motion by MT=+JUMP (31-4). If PREV_PIT-PIT>2 (31-5), the motion is classified as a descending leap motion by MT=-JUMP (31-6). If PIT-PREV_PIT>0 (31-7), MT=+STEP is executed (31-8), thus declaring that the motion is an ascending stepwise motion. If PREV_PIT-PIT>0 (31-9), MT=-STEP is executed (31-10), thus declaring a descending stepwise motion.

STORE MOTION (FIG. 32)

Figure 32:
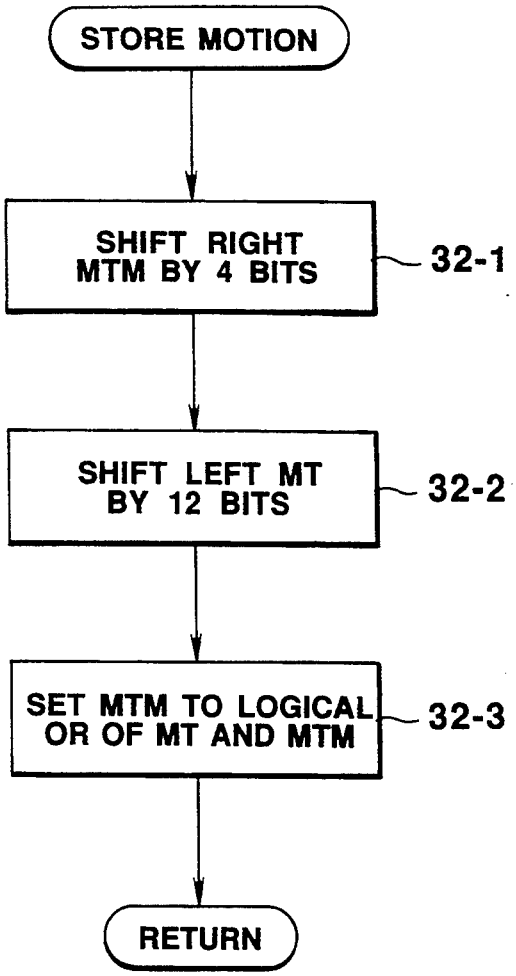
FIG. 32 is a flow chart of STORE MOTION.

FIG. 32 shows details of the STORE MOTION routine. This routine is called in step 27-10 of the rule base extending system or in step 33-8 of the automatic melody composing system. STORE MOTION routine stores the classified motion MT into the motion succession memory MTM by operating MTM as a shift-right register. Thus, step 31-1 shifts right MTM by 4 bits. Step 31-2 shifts left MT by 12 bits so that the classified motion data are placed at the leftmost nibble. Step 31-3 ORes MT and MTM into MTM.

TASK AT NOTE ON (FIG. 33)

Figure 33:
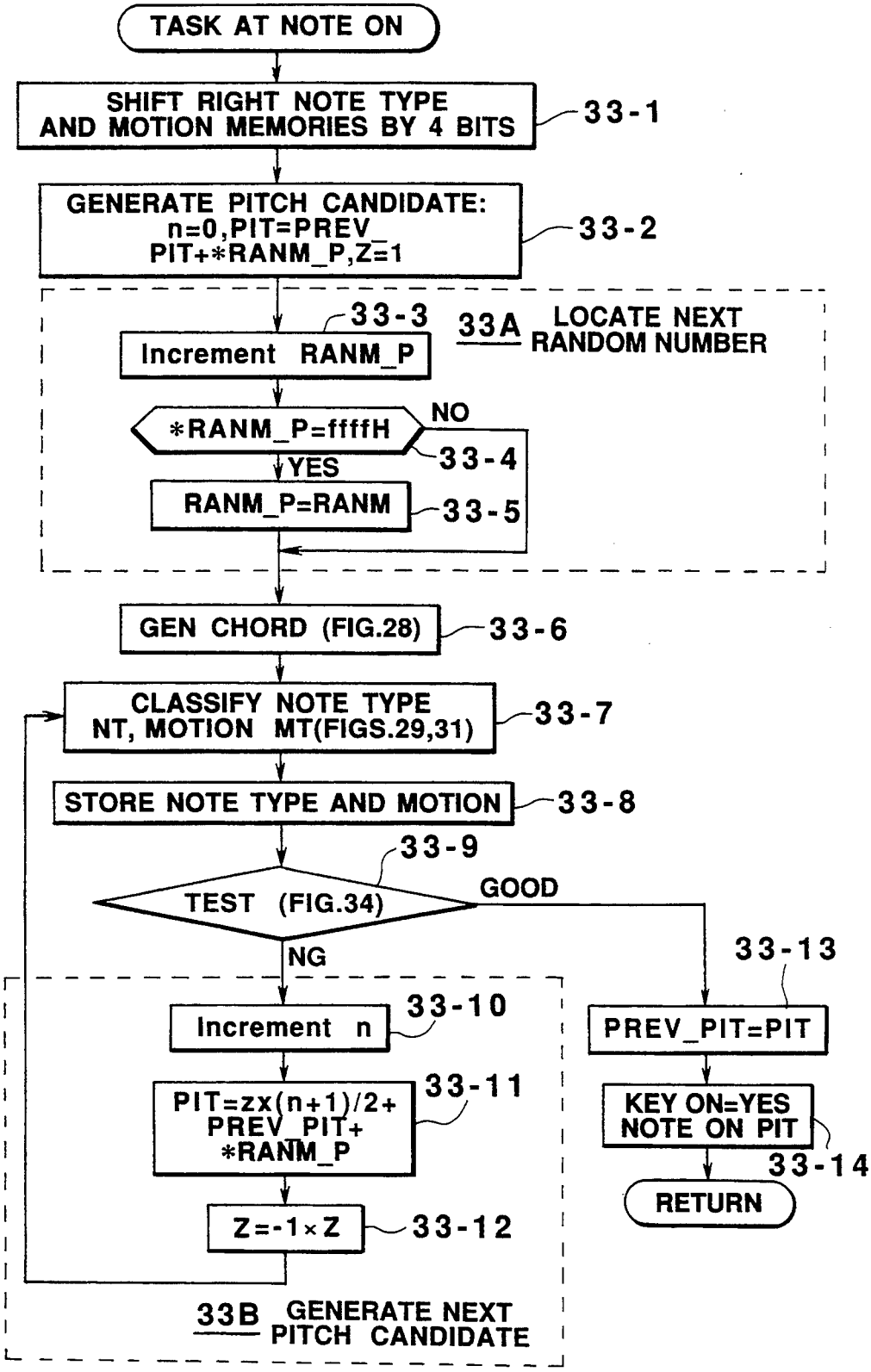

FIG. 33 is a detailed flow chart of the TASK AT NOTE ON routine. This routine is called at a note-on time (16-5). The note-on time is indicated when a bit of "1" is encountered in the note-on pattern word of the rhythm pattern. The object of .TASK AT NOTE ON routine is to determine the pitch of a melody note and note it on as a sound. To this end, the TASK AT NOTE ON routine adds a random number from the random number data memory RANM to an old pitch to thereby create a pitch candidate for a new melody note, on-timing of which has come. The routine tests the pattern of a melody up to the new melody note candidate by matching it against the stored melody pattern rule base. If the rule base includes a matched pattern entry or record, the candidate specifies the new melody note pitch. If the rule base does not include a matched pattern rule entry, the routine creates another pitch candidate and repeates the test.

Specifically, step 33-1 shifts right the note type and motion succession memories NTM and MTM by 4 bits or one note. Step 33-2 generates a pitch candidate in a Markov fashion. This is done by adding a random number *RAMN_P from the random number memory to the old melody note pitch *PREV_PIT. Block 33A (steps 33-3 to 33-5) locates the next random number in preparation for the next execution of the routine: Step 33-3 increments the random number pointer RANM-P. If the end of the random number memory RANM is detected (*RANM_P=ffffH at 33-4), step 33-5 re-initializes the pointer to the start of the random number memory by RANM_P=RANM.

Step 33-6 calls GEN CHORD routine (FIG. 28) to get the current chord information. The entry 33-7 of the loop 33-7 to 33-12 calls CLASSIFY NOTE TYPE routine (FIG. 29) and CLASSIFY MOTION (FIG. 31) to get the classified note type NT and motion MT. Step 33-8 loads NT and MT into the note type and motion succession memories NTM and MTM, respectively,as their leftmost nibble. Step 33-9 calls a TEST routine (FIG. 34) to test the melody pattern (as far as the pitch candidate PIT) stored in NTM and MTM to see whether it is included in the melody pattern rule base. If the rule base does not include the matched pattern rule, the TEST routine returns NG so that the block 33B of steps 33-10 to 33-12 generates the next pitch candidate: Step 33-10 increments N. Step 33-10 computes a pitch candidate by

PIT=Z×(N+1)/2+PREV_PIT+*RANM_P

Step 33-12 executes Z=1×Z.

Then the routine returns to step 33-7 to repeat the process with respect to the candidate generated in the block 33B. When repeating the operation, the block 33B succeesively generates candidates having pitches of (first pitch candidate ±1), ±2, ±3 and so on in this order, in which +1 indicates a semitone up, −1 a semitone down, +2 double semitones up, −2 double semitones down, and so on.

The TEST routine 33-9 returns GOOD if it has found a matched pattern in the melody pattern rule base. Then step 33-13 moves PIT to PREV-PIT. Step 33-14 sets KEY-ON to YES, and notes on PIT as a sound.

In this manner, when the note-on pattern signals a note-on event, the automatic composer determines the pitch meeting a rule in the melody pattern rule base and sounds it out.

TEST (FIG. 34)

Figure 34:
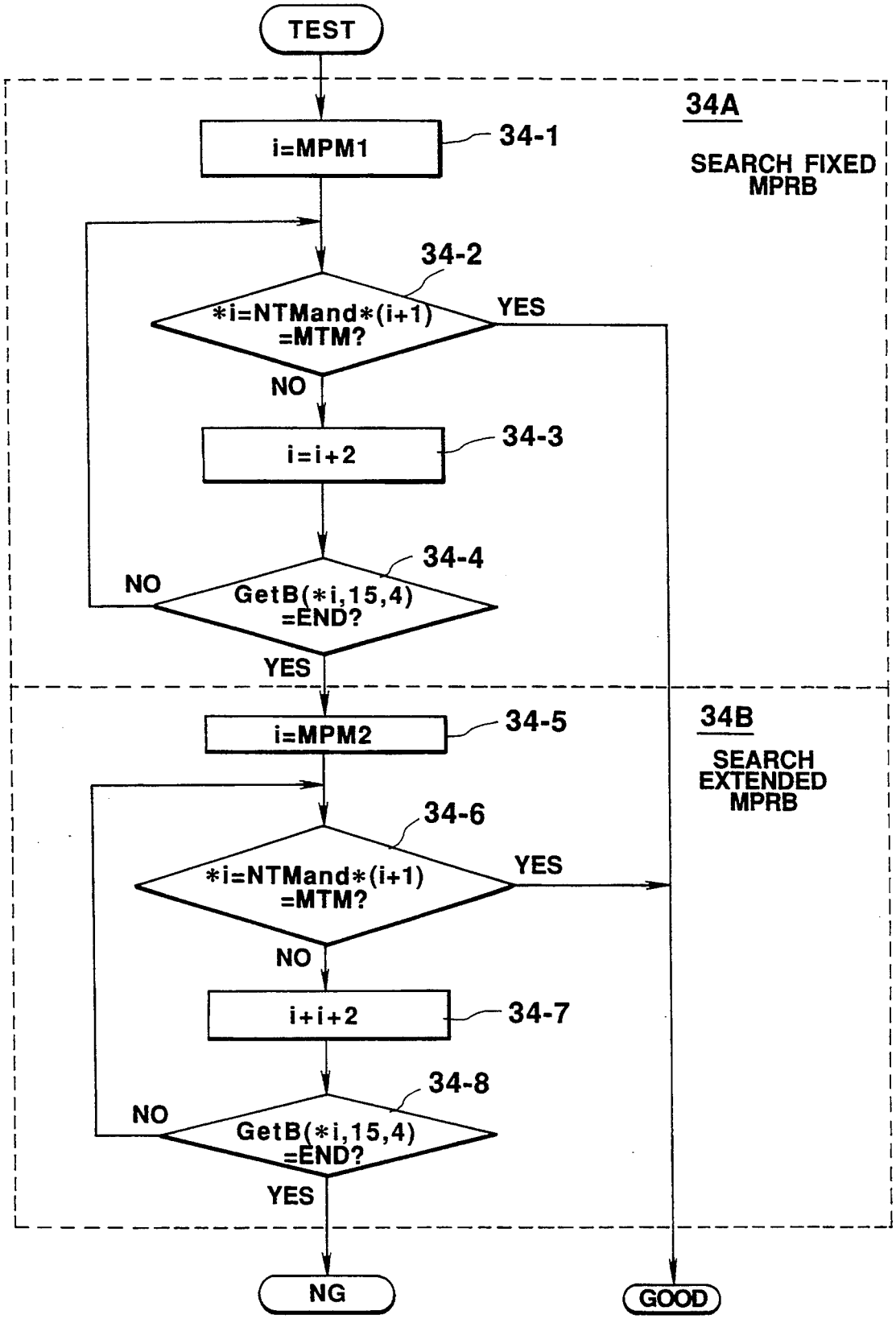
FIG. 34 is a flow chart of TEST for testing or evaluating a melody.

FIG. 34 details the TEST routine called in step 33-9 of TASK AT NOTE ON (FIG. 33). The object of the TEST routine is to test the melody pattern defined by the note type and motion succession NTM, MTM to see whether it satisfies or matches a melody pattern rule in the melody pattern rule base. It should be remenbered that the melody pattern rule base comprises the fixed melody pattern rule base MPM1 residing in ROM 4 and the extended melody pattern rule base MPM2 residing in RAM 6. Thus, the TEST routine searches through both the fixed and extended rule bases for the melody pattern of NTM and MTM.

Block 34A (including steps 34-1 to 34-4) searches the fixed melody pattern rule base MPM1 while block 34B (steps 34-5 to 34-8) searches the extended melody pattern rule base MPM2. Specifically, step 34-1 locates the start of the fixed melody pattern rule base by i=MPM1. In the loop of 34-2 to 34-4, the entry step 34-2 checks whether the note type succession and the motion succession, of an accessed rule match NTM and MTM, respectively. If not matched, step 34-3 locates the next rule by i=i+2. The loop repeates until the step 34-4 detects the end of the fixed melody pattern rule base by Get B(*i, 15, 4)=END If a matched rule is found (34-2) by

*i=NTM and

*i=MTM, the TEST routine returns GOOD.

If the end of the fixed rule base has been reached, step 34-5 locates the start of the extended rule base by i=MPM2. In the loop of 34-6 to 34-8, the entry step 34-6 checks whether the note type succession and the motion succession, of an accessed rule match NTM and MTM of the melody pattern, respectively. If not matched, the step 34-7 locates the next rule by i=i+2. If the step 34-8 does not detect the end of the extended melody pattern rule base, the loop returns to the step 34-6.

If the condition of step 34-6 is met, the TEST routine returns GOOD. If the end of the extended melody pattern rule base has been reached, the TEST routine returns NG because of the failure of the search.

TASK AT NOTE OFF (FIG. 35)

Figure 35:
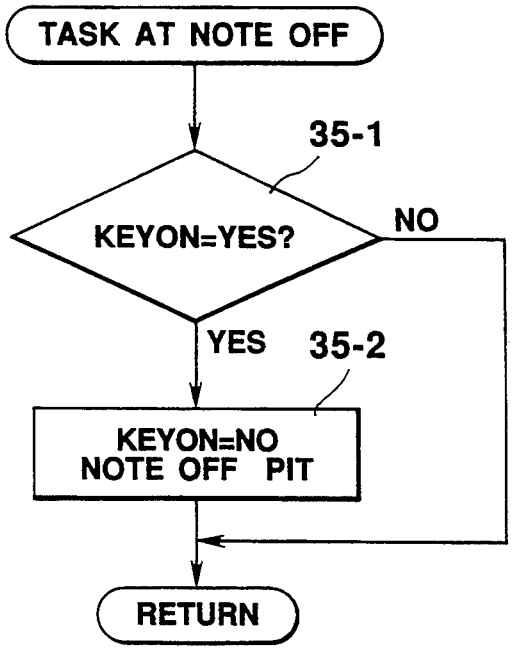
FIG. 35 is a flow chart of TASK AT NOTE OFF.

FIG. 35 details the TASK AT NOTE OFF routine called in step 16-8 when an automatic melody note-off time has come. If KEYON=YES at 35-1, the note of pitch PIT is being sounded. Thus, the step 35-2 sets KEY ON flag to NO and releases the sound of the note PIT.

EXTEND MPRB (FIG. 36)

Figure 36:
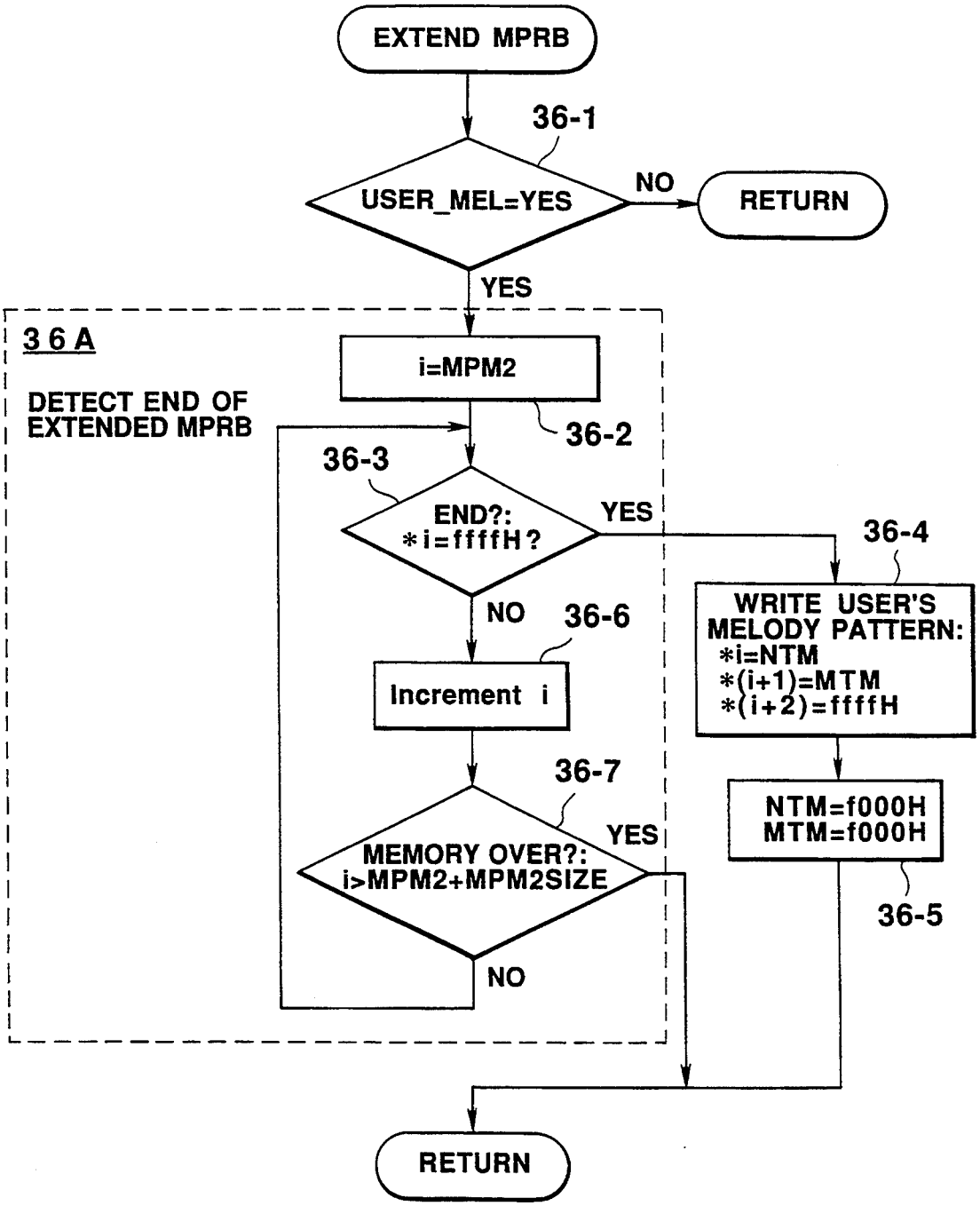
FIG. 36 is a flow chart of EXTEND MPRB for extending a melody pattern rule base.

FIG. 36 is a detailed flow chart of the EXTEND MPRB routine. This routine is called in step 16-13 when a bar-line time has time. The object of the EXTEND MPRB routine is to record a melody pattern derived from a user-melody entered during a measure into the extended melody pattern rule base MPM 2 residing in RAM 6.

Specifically, if USER-MEL=YES is false (36-1), this indicates that no melody has been entered by a user during the measure. Thus, the EXTEND MPRB routines returns directly. If USER-MEL=YES is true, the block 36A (including steps 36-2 to 36-9) detects the end of the extended melody pattern rule base: Step 36-2 locates the start of the extended melody pattern database by i=MPM 2. The first step 36-3 of the loop checks whether an end mark is encountered (*i=ffffH). If not, step 36-6 increment i. Then step 36-7 checks whether the address pointer i has gone beyond the allocated area of the extend melody database, as indicated by i>MPM2+MPM2 SIZE If an end mark is detected (36-3), step 36-4 writes the user-melody pattern into the extended melody pattern database, as an additional rule by

*i=NTM

*(i+1)=MTM, and

*(i+2)=ffffH.

The final step 36-5 re-initializes the note type and motion succession memories by NTM=fOOOH and MTM=fOOOH

COMPLING DATA FORMAT (FIGS. 37–39)

Figure 37:
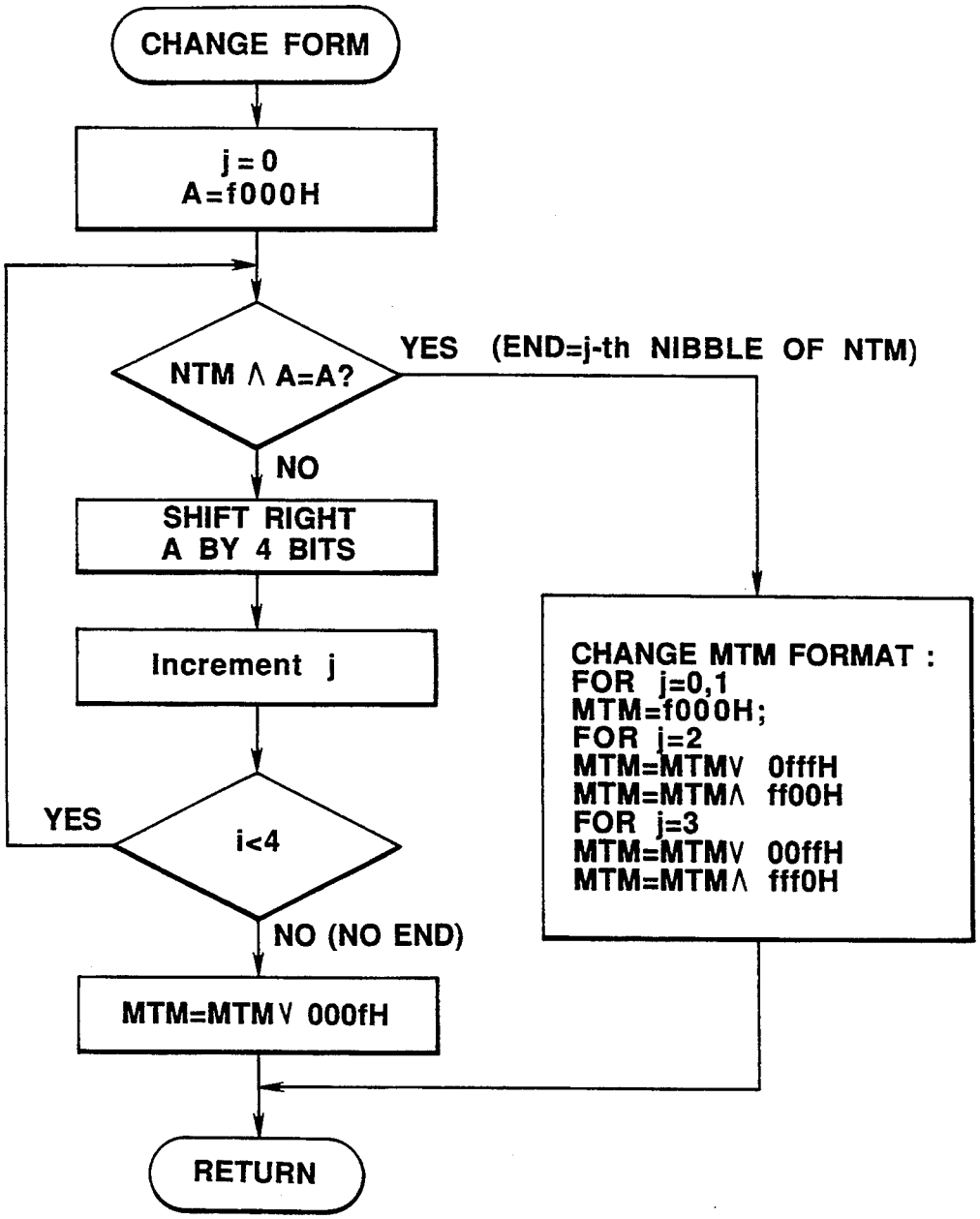
FIG. 37 is a flow chart of CHANGE FORM.

FIG. 37 is a flow chart of CHANGE FORM routine for conforming the format of MTM to that of a rule record in the melody pattern rule base MPM1, MPM2. This routine is called in step 34-1 of the TEST routine (FIG. 34) or in step 36-4 (see FIG. 39) of the EXTEND MPRB routine (FIG. 36). The CHANGE FORM routine is provided to comply the format of the input or test melody pattern represented in NTM and MTM to that of the rule format of the rule base MPM1, MPM2. In the embodiment, at the entry to the TEST or EXTEND MPRB routine, MTM has stored a one extra data item of a motion from the past note that was spinned out or overflowed from NTM. To comply with the rule motion succession format in the melody pattern, the extra data item or nibble should be changed into an END nibble. This is done by the CHANGE FORM routine. In FIG. 37, the symbol indicates a bit-by-bit OR operation, and indicates a bit-by-bit AND operation.

Figure 38:
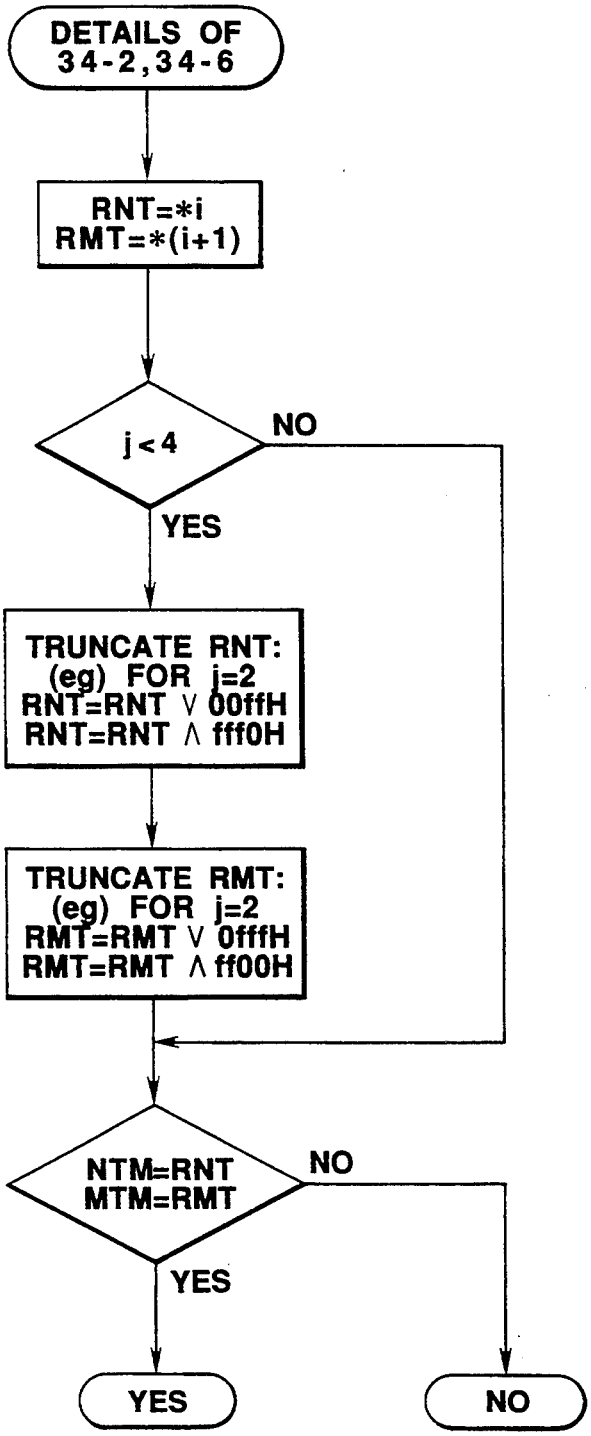
FIG. 38 is a flow chart showing details of step 34-2 and 34-6.

FIG. 38 details the step 34-2 or 34-6 in the TEST routine. According to the routine of FIG. 38, a test melody pattern (represented in NTM and MTM) is said to match or comply to a rule in the melody pattern rule base MPM1 or MPM2 even when it matches only a partial pattern of the rule (not to mention the complete pattern). This will minimizes the required rule base.

Figure 39:
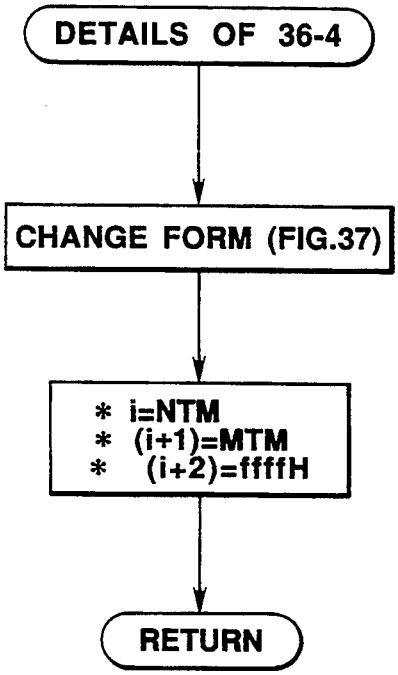
FIG. 39 is a flow chart showing details of step 36-4.

FIG. 39 is a detailed flow chart of the step 36-4 in the EXTEND MPRB routine.

The above description and indications in FIGS. 37–39 per se as well as the other Figures make clear the function and operation of the routines in FIGS. 37–39 so that further description is omitted.

MODIFICATIONS

This concludes the detailed description of the embodiment. However, various modifications or applications will fall well within the scope of the invention.

For example, the melody pattern database (MPRB) 216 may be modified such that it is grouped by music styles.

Figure 40:
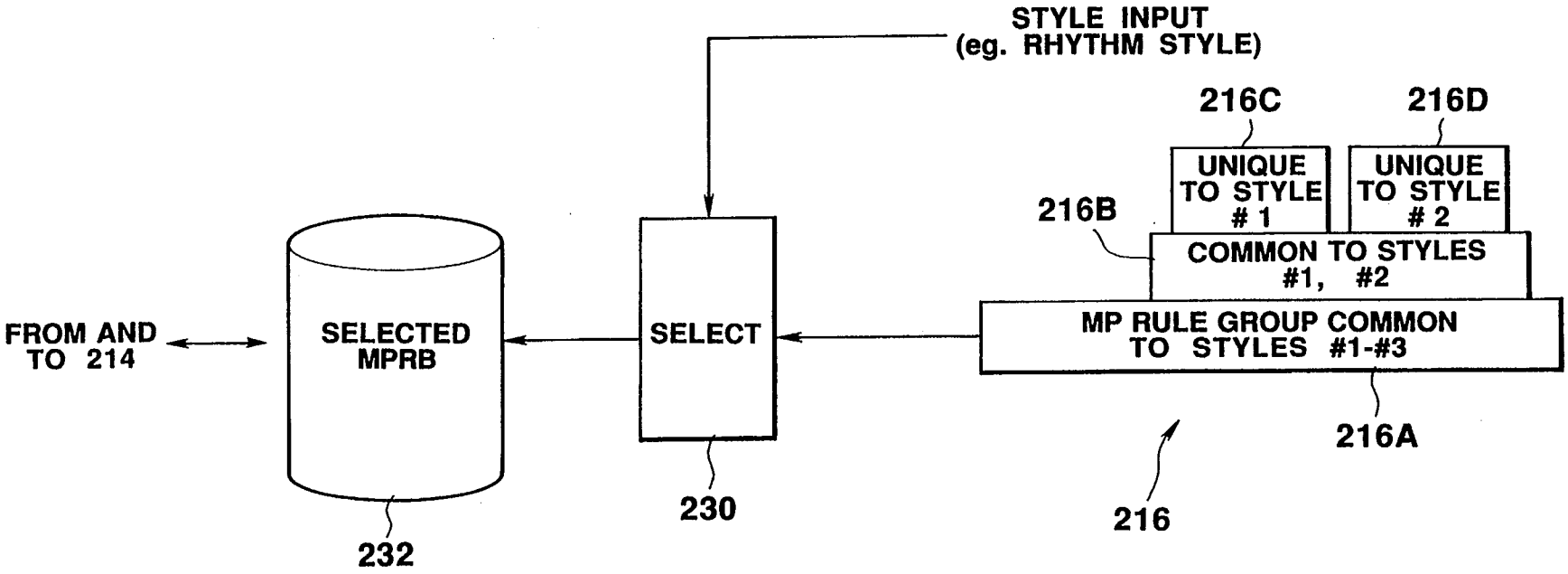
FIG. 40 is a functional block diagram showing an arrangement of a style-grouped melody pattern rule base and associated components.

FIG. 40 illustrates a music-style-grouped MPRB together with associated components. The MPRB 216 illustrated in FIG. 40 includes individual rule bases each for a different one of a plural (here, three) music styles. The block 216A indicates a melody pattern (MP) group commonly applied to all music styles NOs.1 to 3. The block 216B represents a MP group common to music styles NOs.1 and 2. The block 216C represents a MP group applied to the style NO.1 only. The block 216D represents a MP group unique to the style NO.2. There is no rule group unique to the style NO.3. Thus, the Pule base or set for the style NO.1 is defined by the combination of the MP groups 216A, 216B and 216C. The melody pattern rule base for the style NO.2 is defined by the combination of the MP groups 216A, 216B and 216D. The MP group 216A defines the melody pattern rule base for the style NO.3.

In the automatic composing mode, the selector 230 receives the style input (e.g., designated rhythm style 131 in FIG. 1) and prepares the selected MPRB 232 for the style input by retrieving it from the entire rule base 216. The selected MPRB 232 is accessed by a melody pattern test or matching module such as the one 214 in the pitch succession generator 200 of FIG. 1B.

With the arrangement of FIG. 40, the automatic composer can most efficiently compose melodies suitable for a music style.

To support the perfect real-time response of the automatic composer, a quick search or data retrieval feature for a database may readily be implemented. Examples are shown in FIGS. 41 and 42.

Figure 41:
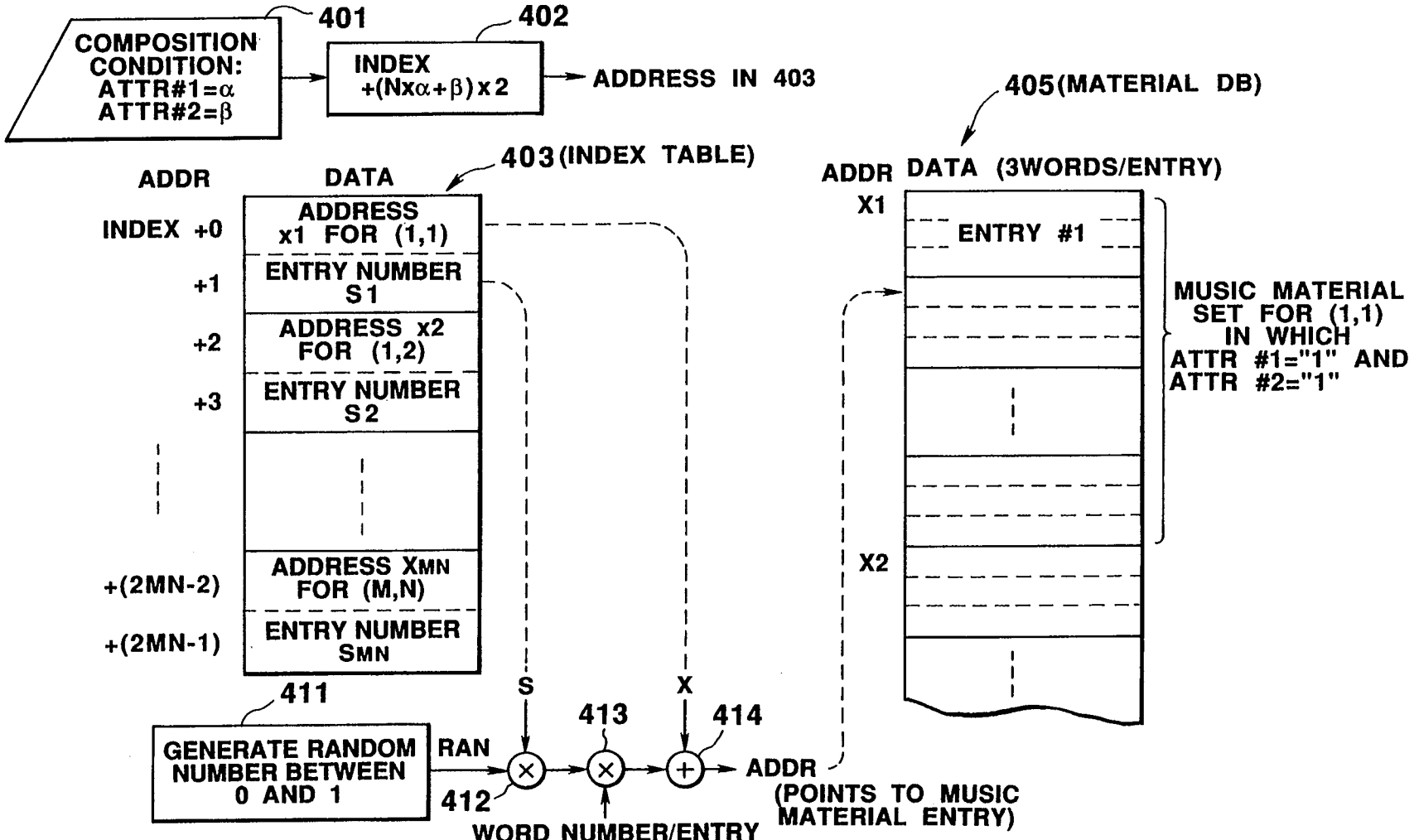
FIG. 41 is a functional block diagram showing a modified arrangement of a musical material database and an associated retrieval system.
Figure 42:
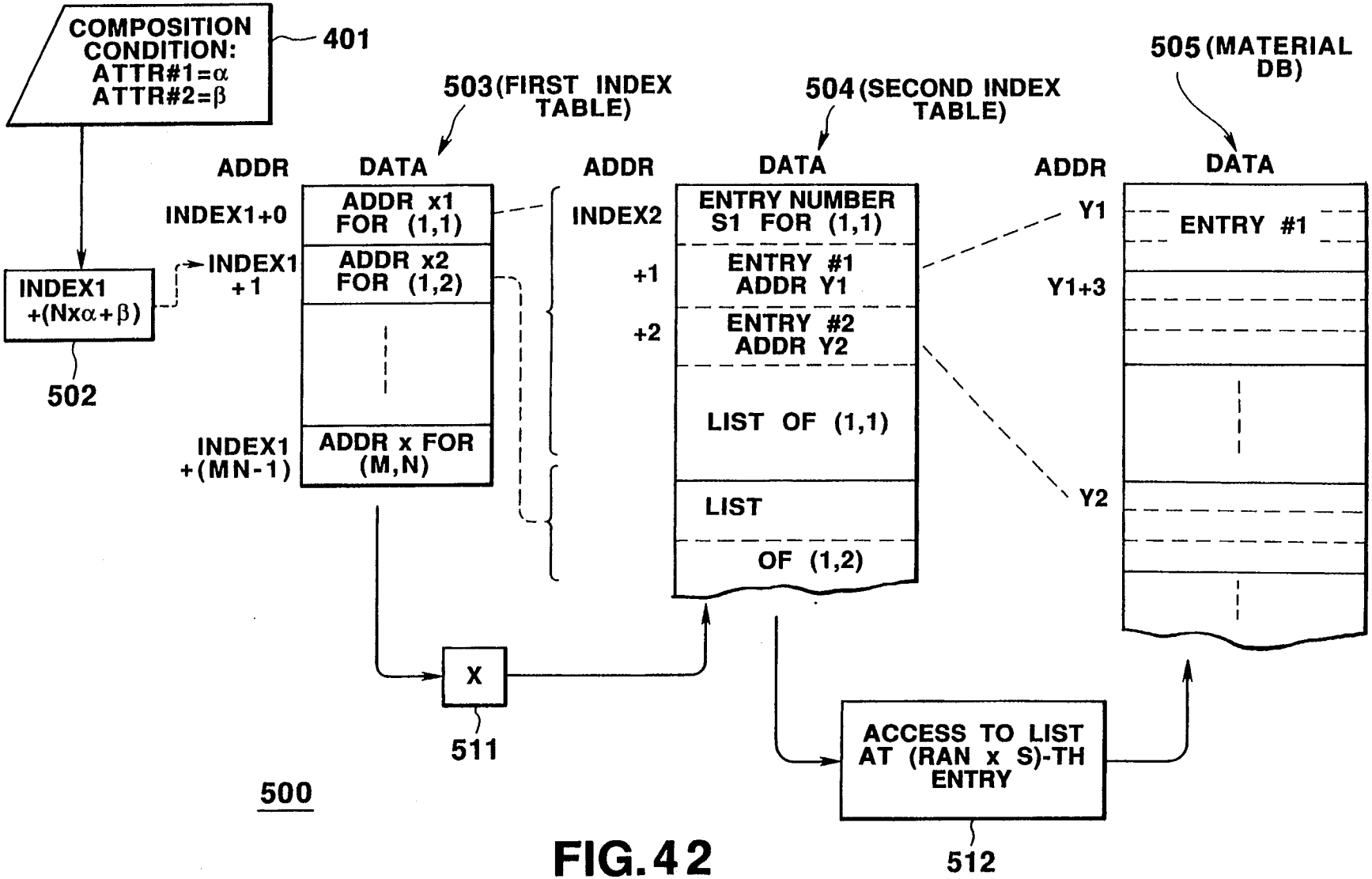
FIG. 42 is a functional block diagram showing a further modified arrangement of a musical material database and an associated retrieval system.

FIG. 41 is a functional block diagram of a modified arrangement of a database of music materials (e.g., rhythm patterns, chord progressions) and an associated data retrieval system. In FIG. 41, the music material database comprises an index table 403 and a database body 405. Composition condition 401 is supplied. For example, the composition condition 401 is defined by specifying two attributes of music (through the number of attributes is not restricted to two). In the block 401, the first attribute (e.g., music structure) is specified by an instance number $\alpha$ while the second attribute (e.g., music style) is specified by $\beta$. The first attribute includes M instances while the second attribute has N instances. The index table 403 is used to provide index information on the database body 405. For each setting of the music composition condition (i.e., each combination of the attributes), the index table 403 stores a location (in terms of start address) in the database body 405 where suitable music materials for the attribute combination are stored, and it also stores a number of the suitable music material entries or records.

In operation, the block 402 uses the composition condition 401 to compute $\text{INDEX}+(N\times\alpha+\beta)X2$ which specifies an address in the index table 403. The computed address in the index table 403 stores an address X in the database body 405 (e.g., start address X1 of those material entries suitable for the first attribute of NO.1 and the second attribute of NO.1). The next address in the index table 403 stores the number S of the material entries (e.g., number S1). The address information X and the entry number S are read out to a search module 410. In the search module 410, a random number generator 411 generates a random number RAN between 0 and 1. Arithmetic elements 412 to 414 of the search module uses the the random number RAN, start address X, entry number S and word number/entry (e.g., 3) of the database body 405, and computes $(\text{RAN}\times S)\times 3+X$ specifying an address ADDR of a music material entry or record to be retrieved from the music material database body 405. Using ADDR(and following addresses as many as the word number/entry), the search module 410 gets access to the music material database body 405, thus retrieving a desired music material meeting the composition condition 401, as part of the music composition.

With the arrangement of FIG. 41, retrieval of a desired music material from the database 405 can be executed in a very short time. However, the database body 405 contains duplicated data records. Thus, the storage efficiency is relatively low.

FIG. 42 shows a further modified arrangement 500 of the music material database and the retrieval system. In this arrangement, the music database is configured by the first and second index tables 503 and 504, and the database body 505. This configuration avoids any duplication of data in the database body 505, assuring high efficiency of storage. The first index table 503 stores index (address) information on the second index table 504. Access to the first index table memory 503 can directly be gained from the composition condition 401. That is, a target address in the table 503 is readily computed by INDEX1 (start address of the table 503)$+(N\times\alpha+\beta)$, as indicated in the block 502.

As indicated in the block 511, index X read from the first index table 503 is used to get access to the second index table 504.

The second index table memory 504 stores, for each composition condition setting, a material entry number S (e.G., the number Sl for the condition setting of (1,1), meaning that the first instance of the first attribute and first instance of the second attribute have been selected) and an address list of the material entries.

Thus, a suitable music material for the desired composition condition 401 can readily be retrieved by reading $(\text{RAN}\times S)$-th entry address from the address list to access the database body 505.

The arrangement of FIG. 42 quickly Generates a desired music material (e.g., melody rhythm, chord progression) complying with the composition condition setting while at the same time avoiding any data duplication in the database body 505.

The invention has been shown and described with respect to the particular embodiments. However, it is to be understood by those skilled in the art that the foregoing and other changes and applications in form and details may be made without departing from the scope of the invention.

What is claimed is:

1. An automatic composer comprising:

music progression providing means for providing a music progression;

melody pattern rule base means for storing rules of melody patterns each representing a melody note succession in terms of a note type succession and a motion succession; and melody composing means for composing a melody fitting with said music progression from said music progression providing means and satisfying rules of melody patterns in said melody pattern rule base means.

2. The automatic composer of claim 1 further comprising:

tempo designating means for designating a performance tempo;

said melody composing means comprising real-time melody composing means for composing a melody in real-time commensurate with said performance tempo; and real-time melody performing means for performing, in real-time, said melody composed by said real-time melody composing means.

3. The automatic composer of claim 1 further comprising:

user-melody input means for inputting a melody from a user;

melody pattern recognizing means for recognizing a pattern of said input melody from said user-melody input means based on said music progression, said recognized pattern being represented by a note type succession and a motion succession; and rule base extending means for recording, as an additional rule, said recognized pattern from said melody pattern recognizing means into said melody pattern rule base means to thereby extend said melody pattern rule base means.

4. The automatic composer of claim 1, composing melody notes sequentially, wherein said melody composing means comprises:

melody pattern storage means for storing a melody pattern represented in a note type succession and a motion succession and derived from a melody as far as an old melody note last composed;

pitch candidate generating means for generating a first pitch candidate for a new melody note to be newly composed;

classifying means for classifying a note type and motion of said first pitch candidate based on pitch of said old melody note and a current situation of said music progression;

test pattern forming means for using said classified note type and motion of said first pitch candidate to update said melody pattern storage means to thereby form a test melody pattern as far as said new melody note having said first pitch candidate;

rule base search means for searching through said melody pattern rule base means for said test melody pattern;

further candidate generating means responsive to failure of said search for generating a further pitch candidate for said new melody note;

repeating means for repeating operation of said classifying means, said test melody pattern forming means and said rule base search means for said further pitch candidate; and pitch determining means responsive to success of said search for determining a pitch of said new melody note by that pitch candidate involved in said success of said search.

5. The automatic composer of claim 1 wherein said music progression providing means comprises:

chord progression generating means for generating a chord progression; and tonality designating means for designating a tonality.

6. An automatic composer comprising:

music progression providing means for providing a music progression;

melody pattern rule base means for storing rules of melody patterns each representing a melody note succession by a note-type succession and a motion succession;

note succession candidate generating means for generating a note succession candidate for a melody to be composed;

melody pattern forming means for recognizing a pattern of said note succession candidate based on said music progression to thereby form a test melody pattern represented in a note type succession and a motion succession;

rule base search means for searching through said melody pattern rule base means for said test melody pattern;

repeating means for repeating operation of said note succession candidate generating means, said melody pattern forming means and said rule base search means while changing said note succession candidate each time till success of said rule base search means in finding a melody pattern rule matching said test melody pattern; and determining means responsive to said success of said rule base search means for determining a note succession of the melody by that note succession candidate involved in said success of said rule base search means.

7. An automatic composer for automatically composing a melody, comprising:

rhythm pattern database means for storing a database of rhythm patterns;

attribute setting means for setting a desired attribute of a note durational succession of a melody to be composed; and melody rhythm composing means for retrieving, from said rhythm pattern database means, a rhythm pattern having said desired attribute to thereby compose said note durational succession.

8. The automatic composer of claim 7 wherein said attribute setting means comprises:

style setting means for setting a desired musical style; and structure setting means for setting a desired musical structure; and wherein said melody rhythm composing means comprises:

access means for accessing said rhythm pattern database means to retrieve a rhythm pattern;

attribute test means for testing said retrieved rhythm pattern to see whether said retrieved rhythm pattern complies with said desired musical style and said desired musical structure;

repeating means for repeating operation of said access means and said attribute test means while changing a rhythm pattern to be retrieved until said attribute test means finds a satisfactory rhythm pattern having passed said test; and determining means for determining said note durational succession by said satisfactory rhythm pattern.

9. The automatic composer of claim 7 wherein rhythm pattern data stored in said rhythm pattern database stored in said rhythm pattern database means contains attribute information in addition to note on and off timing information.

10. An automatic composer for automatically composing a melody and a chord progression, comprising:

chord progression database means for storing a database of chord progressions;

attribute setting means for setting a desired attribute of a chord progression to be composed; and chord progression composing means for retrieving, from said chord progression database means, a chord progression having said desired attribute to thereby compose a chord progression.

11. The automatic composer of claim 10 wherein said attribute setting means comprises:

style setting means for setting a desired musical style; and structure setting means for setting a desired musical structure; and wherein said chord progression composing means comprises:

access means for accessing to said chord progression database means to retrieve a chord progression;

attribute test means for testing said retrieved chord progression to see whether said retrieved chord progression complies with said desired musical style and said desired musical structure;

repeating means for repeating operation of said access means and said attribute test means while changing a chord pattern to be retrieved until said attribute test means finds a satisfactory chord progression having passed said test; and determining means for determining said chord progression by said satisfactory chord progression.

12. The automatic composer of claim 10 wherein chord progression data stored in said chord progression database means contains attribute information in addition to information on a chord succession in which each chord is specified by a root and a type.

13. An automatic composer comprising:

musical material database means for storing a database of musical materials for music composition;

condition setting means for setting conditions of music composition;

retrieval means for retrieving a musical material from said musical material database means;

testing means for testing said retrieved musical material with respect to said set conditions of music composition;

repeating means for repeating operation of said retrieval means and said testing means while changing a music material to be retrieved until said testing means finds a music material complying with said set condition of music composition; and composing means for composing said found music material as part of said music composition.

* * * * *